United States Patent [19]

Katoh et al.

[11] Patent Number: 4,726,276

[45] Date of Patent: Feb. 23, 1988

[54] SLUR EFFECT PITCH CONTROL IN AN ELECTRONIC MUSICAL INSTRUMENT

[75] Inventors: Mitsumi Katoh; Masatada Wachi; Tokuji Hayakawa, all of Hamamatsu, Japan

[73] Assignee: Nippon Gakki Seizo Kabushiki Kaisha, Hamamatsu, Japan

[21] Appl. No.: 879,154

[22] Filed: Jun. 26, 1986

[30] Foreign Application Priority Data

Jun. 28, 1985 [JP] Japan ..... 60-142054
Aug. 30, 1985 [JP] Japan ..... 60-189979

[51] Int. Cl.[4] ..... G10H 1/02; G10H 1/06; G10H 1/46

[52] U.S. Cl. ..... 84/1.19; 84/1.24; 84/1.26; 84/1.27

[58] Field of Search ..... 84/1.11–1.13, 84/1.19–1.27

[56] References Cited

U.S. PATENT DOCUMENTS 3,848,092 11/1974 Shamma ..... 84/1.27 X
4,524,668 6/1985 Tomisawa et al. ..... 84/1.24

FOREIGN PATENT DOCUMENTS 107722 8/1979 Japan .
139095 8/1984 Japan .

*Primary Examiner*—S. J. Witkowski
*Attorney, Agent, or Firm*—Spensley Horn Jubas & Lubitz

[57] ABSTRACT

The present invention provides a tone color control so that the tone color in an attack portion of a tone to be generated differs depending upon whether or not a slur effect is to be imparted. If, for example, the slur effect is not imparted, a tone color for an attack portion of a tone which is rich in variation is used, whereas if the slur effect is to be imparted, a stable tone color which is the same as the sustain portion of a tone is used. In another aspect of the invention, in the case of imparting the slur effect, a tone signal is distributed to two channels and envelopes of signals in the respective channels are separately and independently controlled by separate control signals. In one channel, a control signal of decay characteristics is used whereas in the other channel, a control signal of attack characteristics is used. The changing rate of the control signal of the attack characteristics is made greater than that of the control signal of the decay characteristics.

8 Claims, 21 Drawing Figures

INTERFACE 14

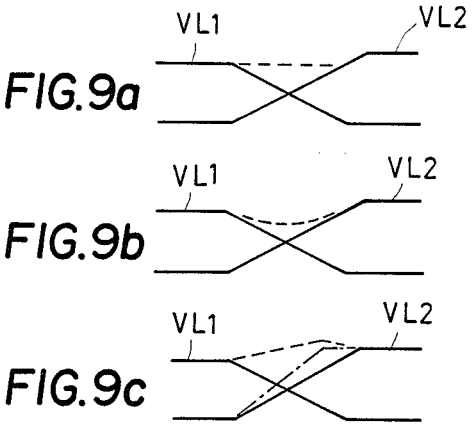
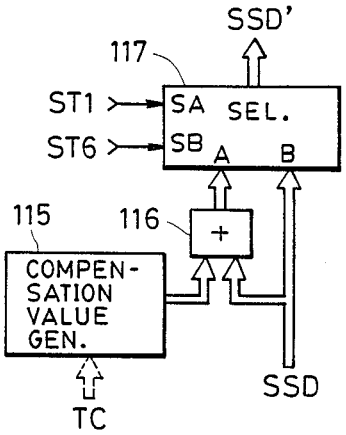
FIG. 10
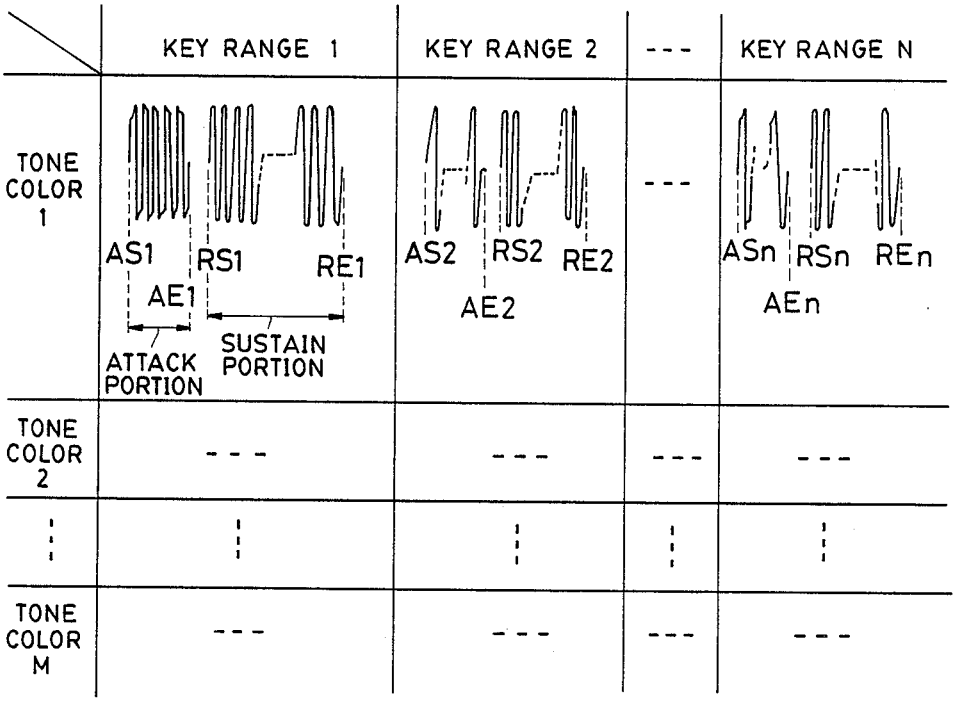
FIG. 12

SLUR EFFECT PITCH CONTROL IN AN ELECTRONIC MUSICAL INSTRUMENT

BACKGROUND OF THE INVENTION

This invention relates to an electronic musical instrument realizing a musical effect of gradually changing a pitch of a tone to be produced such as slur or portamento and, more particularly, to an electronic musical instrument in which a waveshape of an attack portion of a tone imparted with such pitch change is made different from a waveshape of an attack portion of that not imparted with such pitch change. Further, this invention relates to an electronic musical instrument in which control of an amplitude level is performed by taking into account an auditory tone level change in a case where the amplitude level of a tone is gradually changed with the pitch.

The effect according to which the pitch of a tone is changed smoothly from a tone pitch corresponding to a first key to a tone pitch corresponding to a second key is known as "slur" or "portamento" (hereinafter simply referred to as "slur"). Japanese Preliminary Patent Publication 139095/1984 discloses a system according to which a natural slur effect can be realized by smoothly changing not only the pitch but also the tone color of a tone. According to this publication, by adding and thereby combining tone signals of two channels with tone colors which are slightly different from each other at a level ratio which changes with time, a resulting timewise change in the tone color during imparting of slur is realized. More specifically, the tone color of one channel is a tone color which has been key-scaled in accordance with the tone pitch of a key which was being depressed until the present key has been depressed and the tone color of the other channel is a tone color which has been key-scaled in accordance with the tone pitch of the key which has been presently depressed. Accordingly, the tone color change during the slur period is not the tone color change proper to the slur but merely a smooth change in the tone color key-scaled by a precedingly depressed key to the tone color key-scaled by a presently depressed key.

In a natural musical instrument, there is a considerable difference in the tone color between an attack portion and a sustain portion of a tone and an attack portion of a new tone in the slur period also exhibits a unique tone color change. In the slur period, characteristics of the tone color of an attack portion of a new tone are closer to the tone color of a sustain portion than those of the tone color of a normal attack portion are. Such tone color change peculiar to the slur period was hard to realize by the prior art control technique which merely shifts the key-scaled tone color smoothly. Particularly, in an electronic musical instrument of a type which, for simulating the difference in the tone color in a tone between the attack portion and the sustain portion, employs a tone generation system which generates tone waveshapes of attack and sustain portions which have different tone color characteristics from each other, a tone waveshape having tone color characteristics of a normal attack portion is generated whether it is in the slur period or not and, accordingly, the imparting of smooth change in the key-scaled tone color as proposed in the prior art cannot restrain the tone color characteristics of the normal attack portion and therefore a tone color change proper to the slur period cannot be realized.

The above described publication discloses also a system according to which tone signals exhibiting the same slur pitch change are generated in two channels, the tone levels of the two tone signals are caused to change in such a manner that they have opposite characteristics and cross each other (crossfade). More specifically, as shown in FIG. 14*a*, the tone level of one channel is caused to fall relatively steeply at a predetermined decay rate from level L1 which was key-scaled in accordance with the tone pitch of a key which was being depressed until the present key has been depressed while the tone level of the other channel is caused to rise relatively gradually to level L2 which was key-scaled in accordance with the tone pitch of the present key.

In the tone level control as shown in FIG. 14*a*, however, the sum of the tone levels of the two systems falls as shown by the dotted line in the figure. This is because the decay rate is steeper than the attack rate. If the same rate is used for the decay rate and the attach rate as shown by FIG. 14*b*, the total tone level arithmetically becomes flat as shown by the dotted line but, in actual hearing, it gives the impression that the tone level somewhat drops in the portion in which the two levels cross.

SUMMARY OF THE INVENTION

It is, therefore, an object of the invention to provide an electronic musical instrument capable of producing a tone color proper to the slur period by differing the tone color of an attack portion of a tone during the slur period from the tone color of a normal attack portion.

It is another object of the invention to prevent fall in the tone level as described above which occurs during a period of time for imparting pitch change such as slur.

For achieving the first object of the invention, the electronic musical instrument according to the invention comprises mode selection means for selecting one of a first mode and a second mode, tone generation means for generating a tone signal of a tone to be generated, pitch control means for gradually changing a pitch of said tone to be generated from a first pitch to a second pitch in an attack portion of said tone when said first mode is selected by said mode selection means and for rendering said pitch said second pitch during said attack portion of said tone when said second mode is selected by said mode selection means, and tone color control means for imparting a first tone color to said attack portion of said tone when said first mode is selected and for imparting a second tone color different from said first tone color to said attack portion of said tone when said second mode is selected.

In one aspect of the invention, the tone generation means is capable of selectively generating a tone waveshape for an attack portion and a waveshape for a sustain portion and the tone color control means generates the tone waveshape for the sustain portion in the attack portion of the tone signal during the first mode and generates the tone waveshape for the attack portion of the tone signal during the second mode.

In another aspect of the invention, the tone generation means is capable of selectively generating a tone waveshape for an attack portion and a tone waveshape for imparting slur and the tone color control means selectively generates the tone waveshape for imparting slur in the attack portion of the tone signal during the first mode and generates the tone waveshape for the attack portion in the attack portion of the tone signal during the second mode.

In another aspect of the invention, the selection of the first mode or the second mode is performed in accordance with the manner of operating a key in the keyboard for designating the tone pitch of the tone to be generated. If, for example, a legato form has been adopted as the manner of operating a key in switching a depressed key, i.e., if the manner of operating a key in which a new key is depressed before the precedingly depressed key has been released has been adopted, the first mode is selected. If, on the other hand, the manner of operating a key in which a new key is depressed after the precedingly depressed key has been completely released, i.e., a staccato form has been adopted, the second mode is selected.

According to the invention, when the first mode has been selected, the pitch of the tone to be generated gradually changes from the predetermined first pitch to the second pitch in the attack portion of the tone so that a pitch change like slur is imparted to the tone. When the second mode has been selected, the pitch of the tone to be generated is the second pitch (i.e., pitch corresponding to the tone pitch of the tone) from the beginning so that the pitch change like slur is not imparted. By the control of the tone color control means, the tone color of the attack portion of the tone signal generated by the tone generation means is varied depending upon the first or second mode. In the first mode, for example, a tone waveshape capable of realizing a tone color proper to the slur period such as a tone waveshape for a sustain portion or a tone waveshape for imparting slur is generated in the attack portion of the tone signal whereas in the second mode, a tone waveshape of a normal attack portion is generated. In this manner, the tone color of the attack portion during the slur period can be made different from the tone color of the normal attack portion whereby the tone color change proper to the slur period can be realized.

FIG. 1 is a diagram which schematically shows an example of carrying out the invention for better understanding of the invention. This diagram shows an example in which the first tone which precedes in the order of sounding rises in the second mode (i.e., the key has been depressed in the staccato form and no slur pitch change is imparted in the attack portion) and the second tone rises in the first mode (i.e., the key has been depressed in the legato form and the slur pitch change has been imparted in the attack portion). Since the first tone rises in the second mode, it is generated with the first pitch corresponding to its proper tone pitch from the begnning and its tone waveshape in the attack portion is the tone waveshape of a normal attack portion. In the known manner, the tone waveshape of the sustain portion is used upon completion of the tone waveshape of the attack portion. Since, on the other hand, the second tone rises in the first mode, its pitch gradually changes from the first pitch to the second pitch corresponding to its proper tone pitch and the tone waveshape of the sustain portion is used as the tone waveshape of the attack portion from the beginning. The amplitude envelope of this tone waveshape of the sustain portion used in the attack portion of the second tone rises with predetermined attack characteristics while the amplitude envelope of the first tone falls with predetermined decay characteristics.

The electronic musical instrument achieving the other object of the invention comprises tone generating means having at least two tone generation channels for generating a tone to be produced, said tone being determined by a first tone signal and a second tone signal generated from said generation channels respectively, pitch change imparting means for gradually changing pitches of said first tone signal and said second tone signal from first pitch to a second pitch, and means for generating a first control signal which changes gradually an amplitude level of said first tone signal from a first level to a second level and a second control signal which changes gradually an amplitude level of said second tone signal from a third level to a fourth level, a rate of changing from said third level to said fourth level being greater than a rate of changing from said first level to said second level.

By making the rate of changing of the second control signal greater than the rate of changing of the first control signal, the attack rate of the tone level in one channel can be made steeper than the decay rate of the tone level in the other channel as shown in FIG. 14*c*. The total tone level of the two channels can thereby be reinforced in the crossing portion as shown by the dotted line in FIG. 14*c* and deficiency in the tone level in hearing can be compensated for.

Preferred embodiments of the invention will be described below with reference to the accompanying drawings. BRIEF DESCRIPTION OF THE DRAWINGS In the accompanying drawings, FIG. 1 is a waveshape diagram schematically showing an example of carrying out the invention;

FIG. 2 is a block diagram showing an entire construction of an embodiment of the electronic musical instrument according to the invention;

FIGS. 3*a* and 3*b* are flow charts showing an example of a key-on event program carried out by a microcomputer section in FIG. 2;

Figure 1:
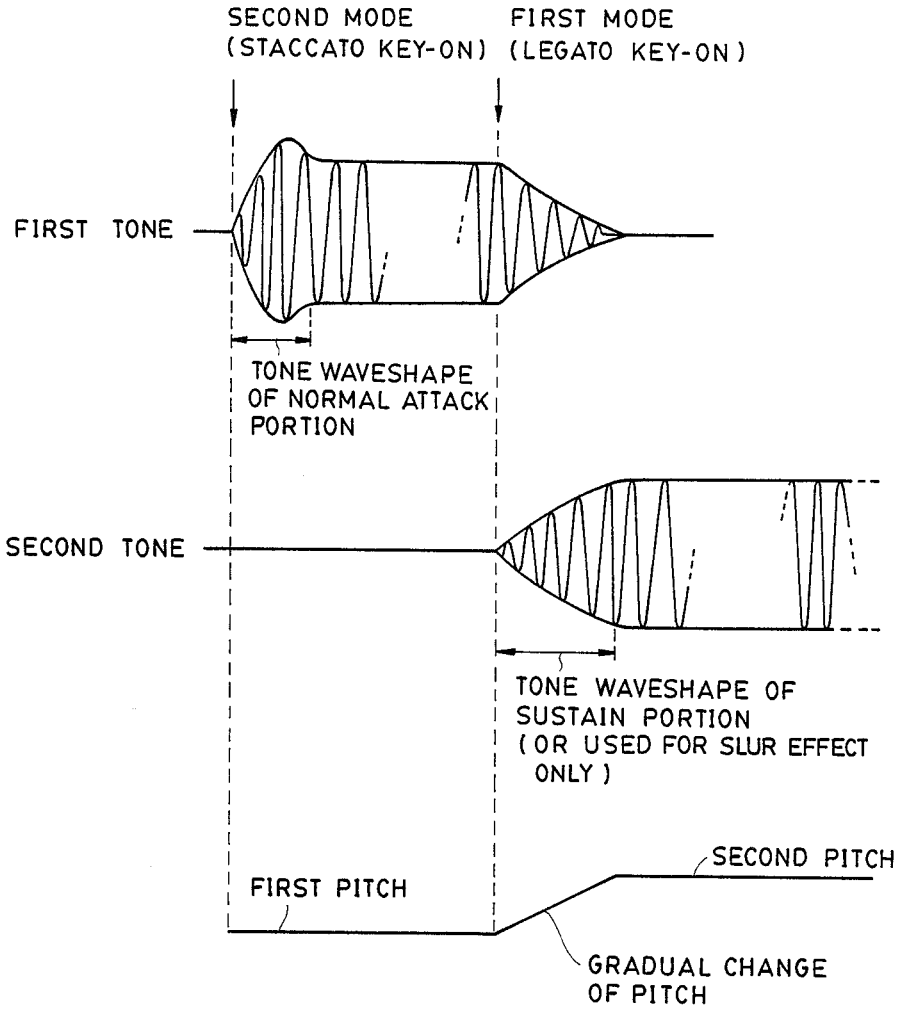
Figure 2:
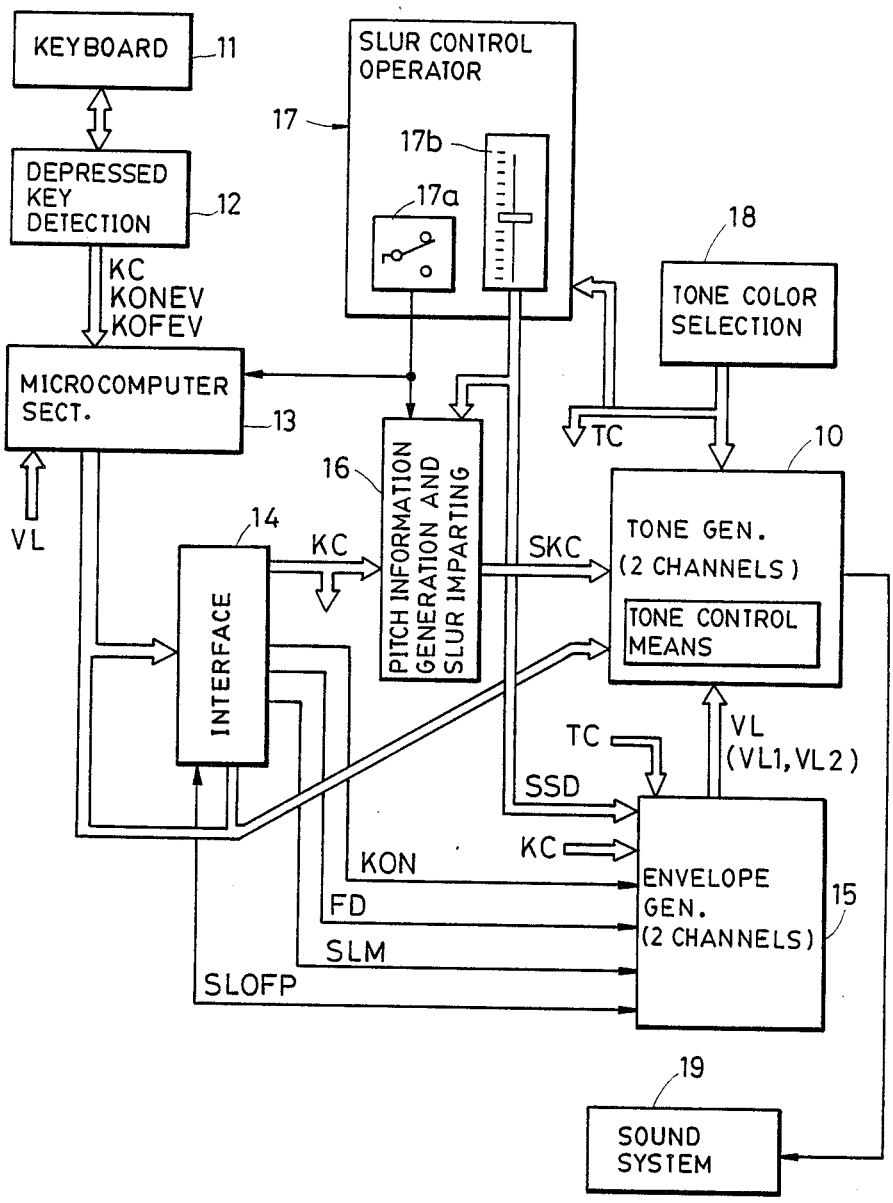
Figure 5:
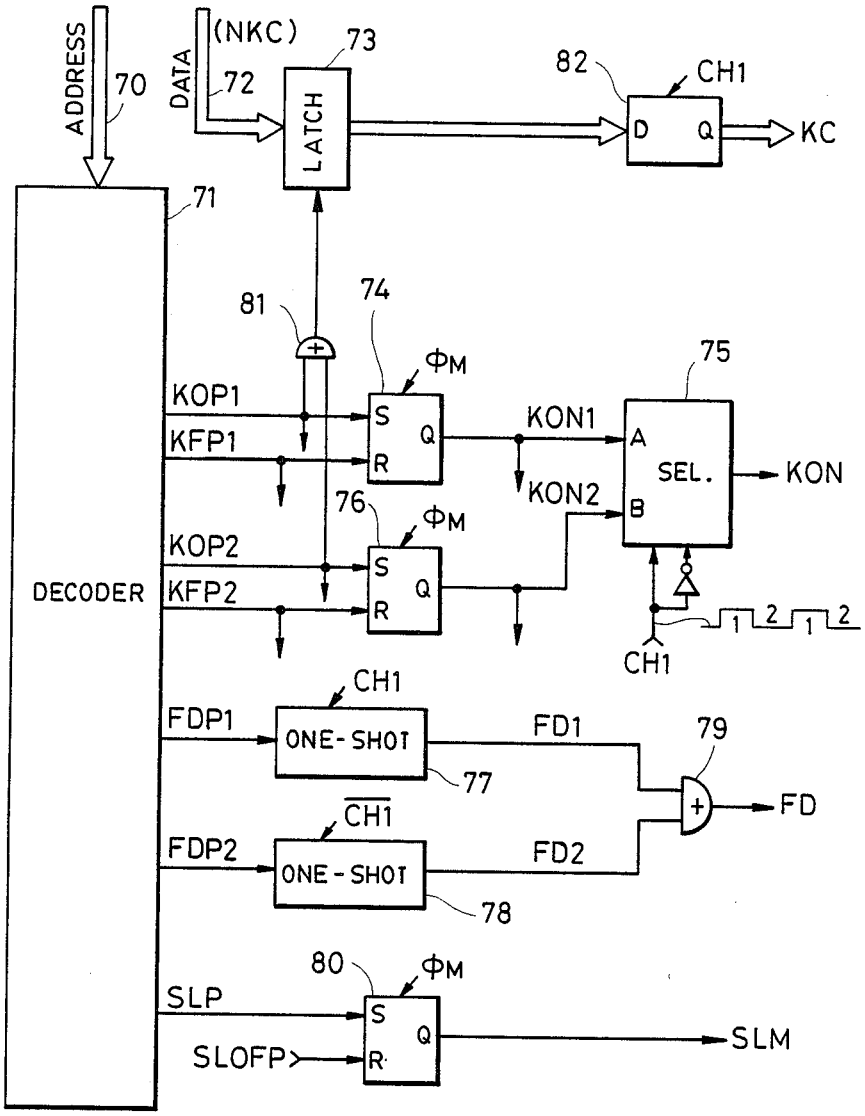
FIG. 5 is a block diagram showing an example of interface in FIG. 2.
Figure 6:
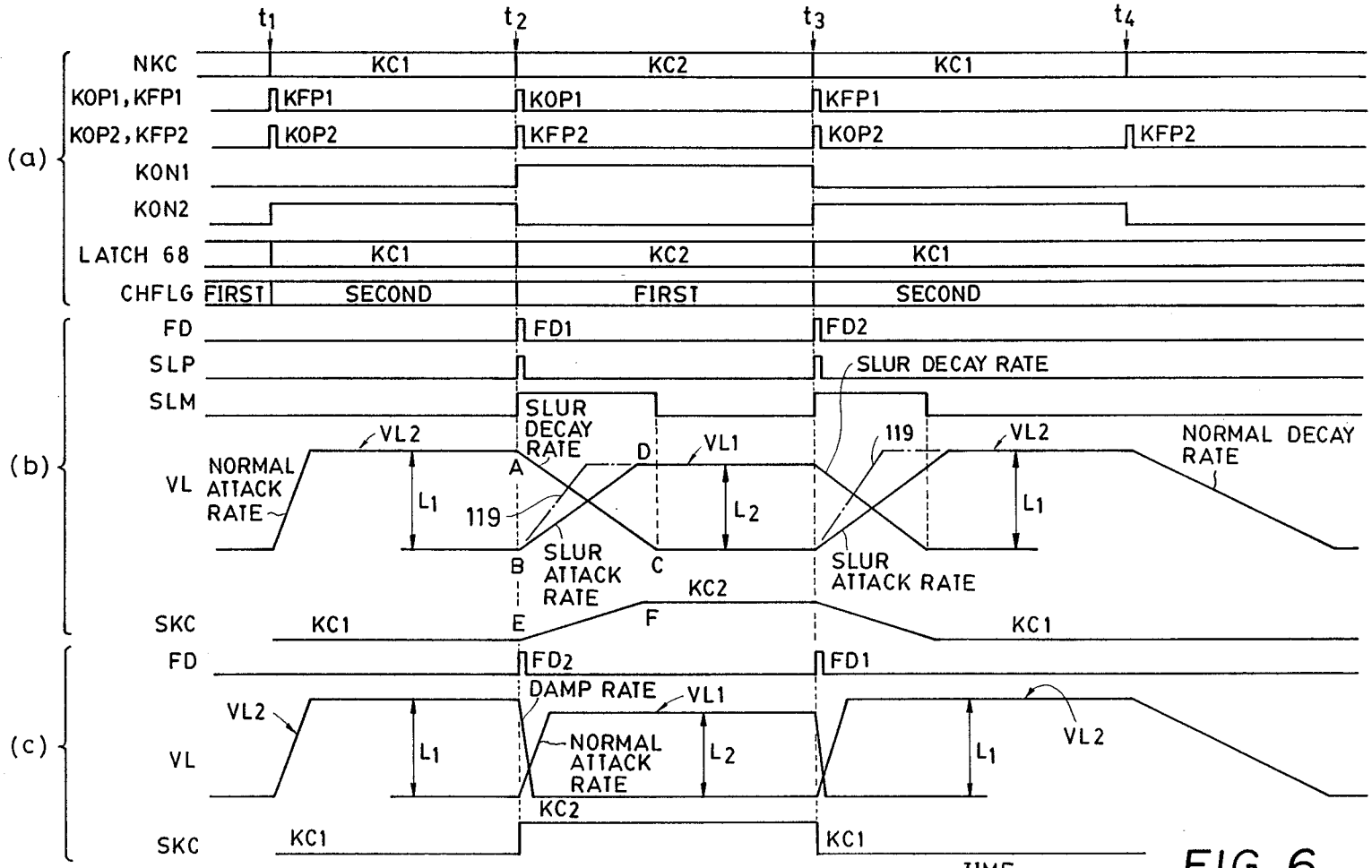
Figure 7:
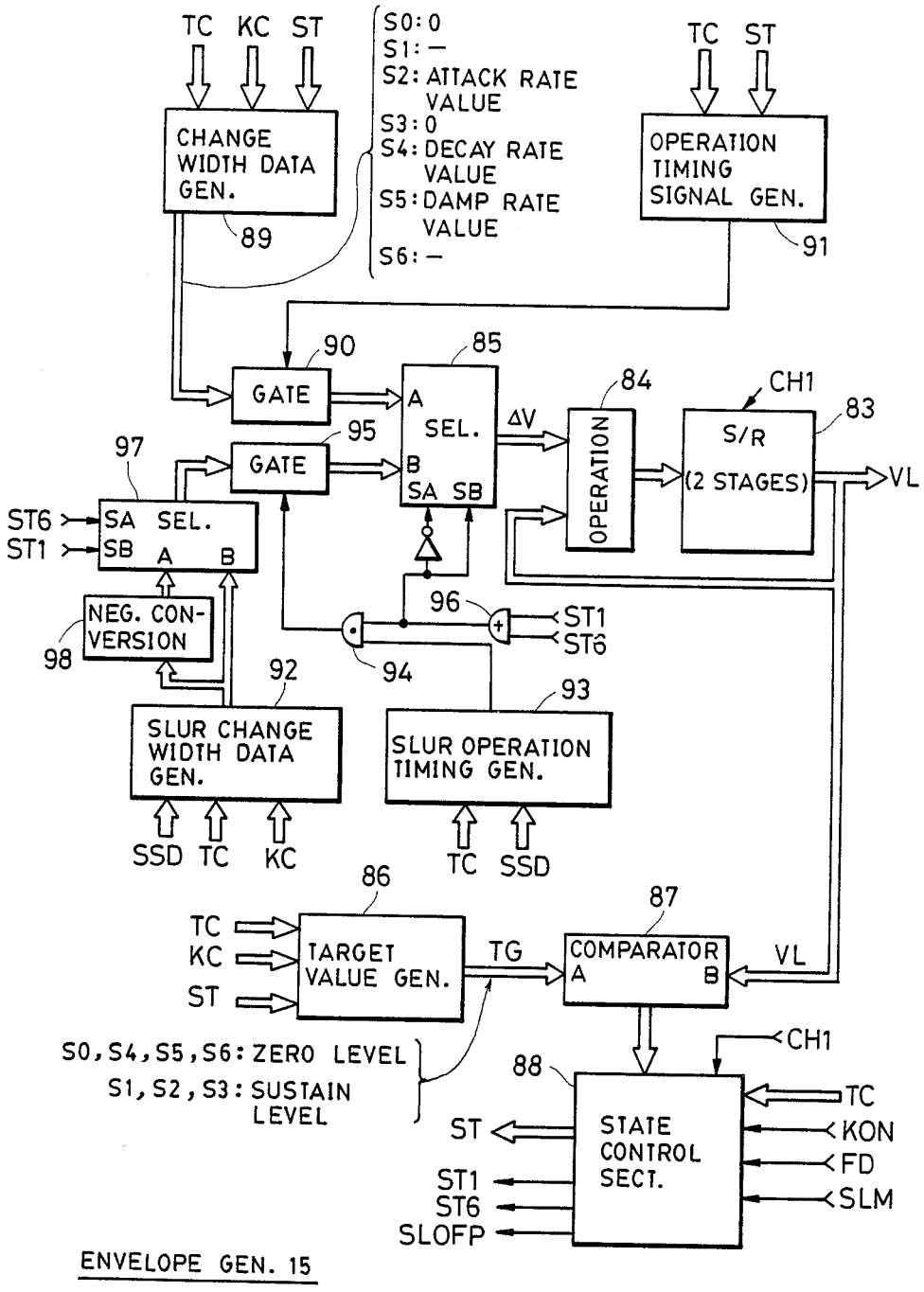
Figure 8:
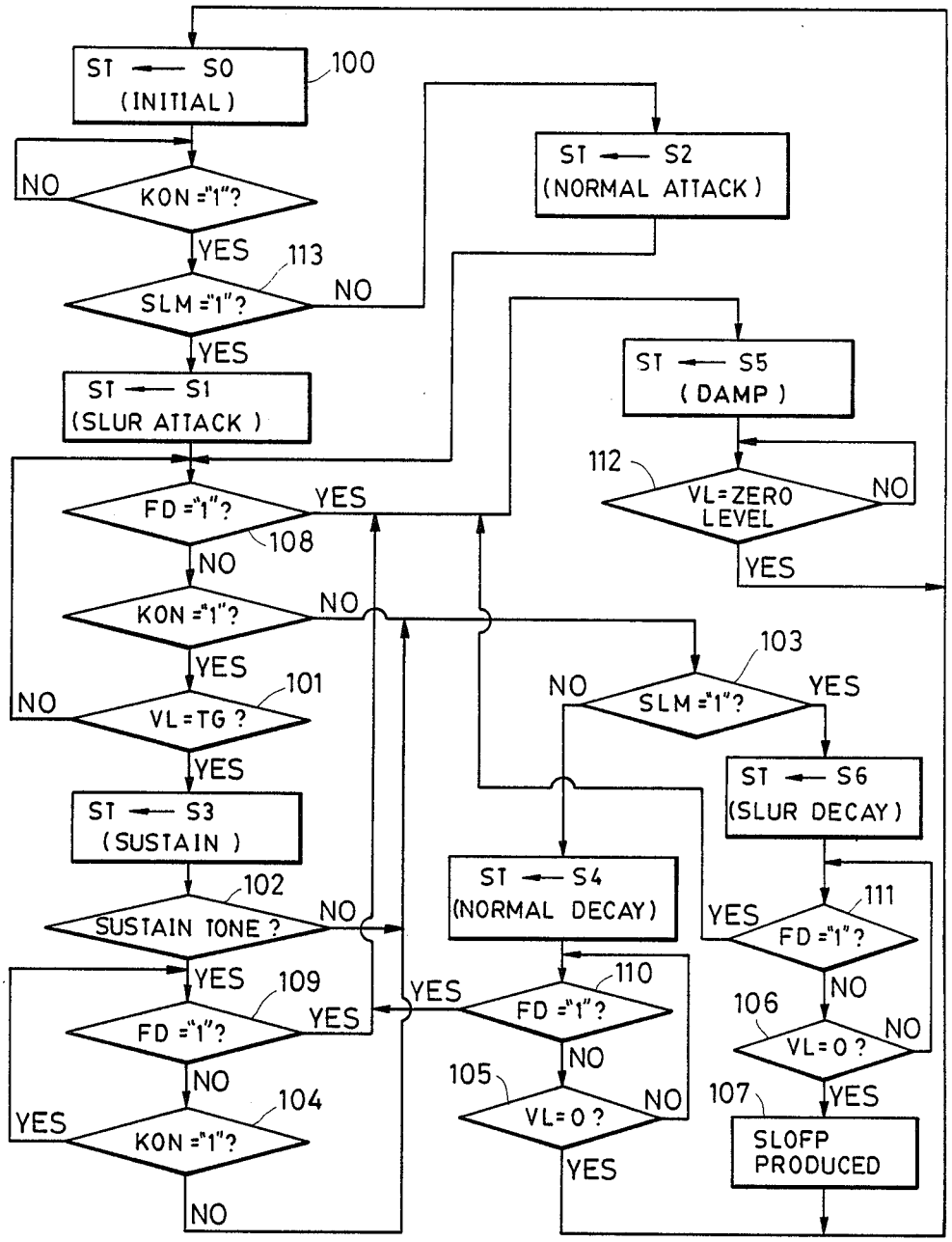
Figure 11:
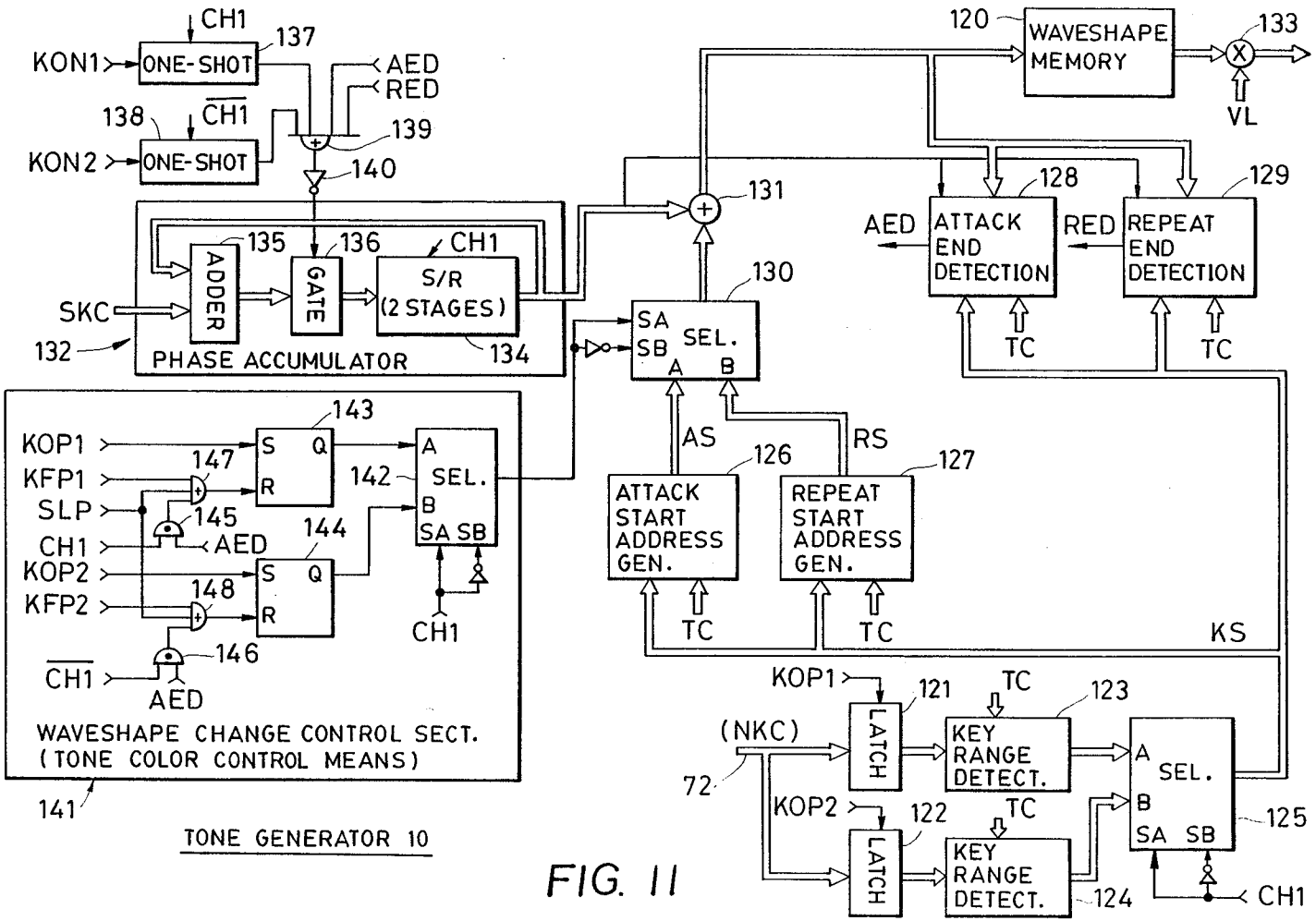
Figure 13:
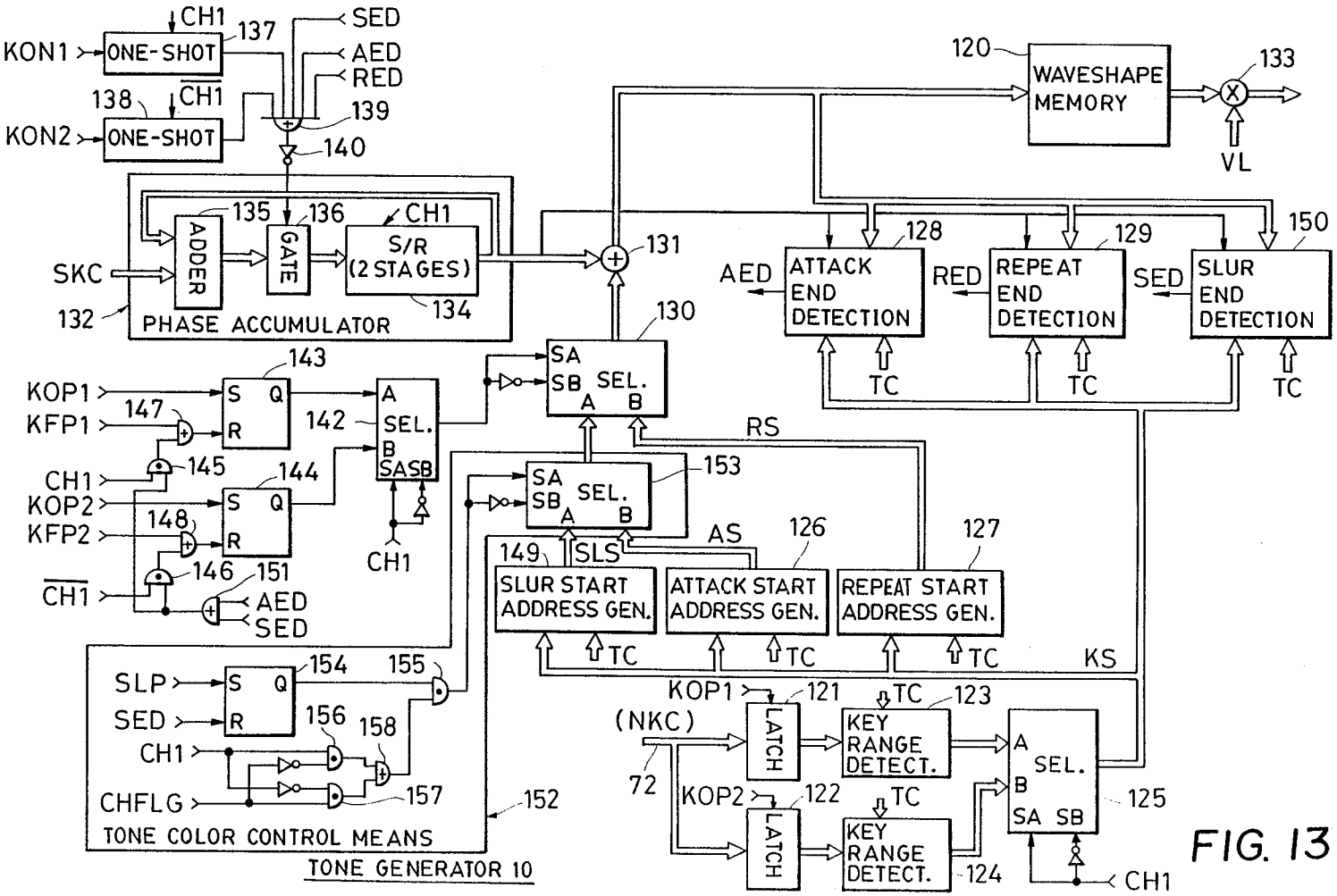
Figure 14A:
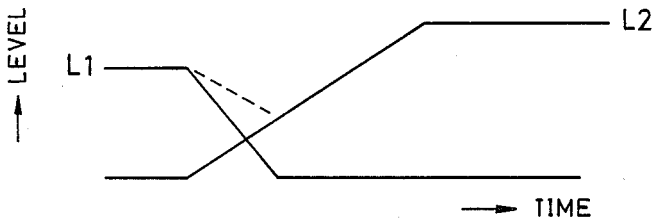
Figure 14B:
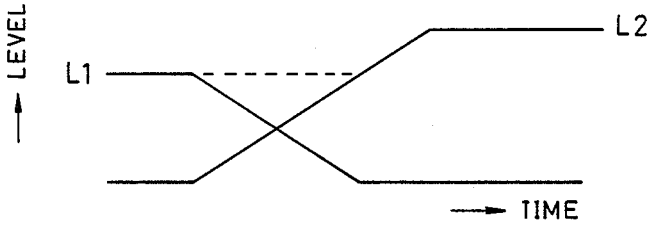
Figure 14C:
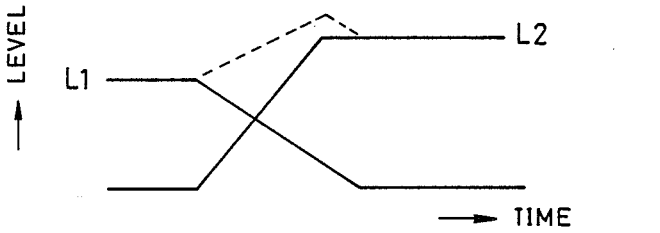

FIGS. 6(*a*)–(*c*) are time charts showing examples of generation of output signals in the respective portions in FIG. 5, an envelope signal and pitch information;

FIG. 7 is a block diagram showing an example of an envelope generator in FIG. 2;

FIG. 8 is a flow chart showing an example of processings carried out by a state control circuit in FIG. 2;

FIGS. 9*a*, 9*b* and 9*c* are diagrams each showing composite levels of envelopes of a decay portion of a preceding tone and an attack portion of a new tone during the slur period;

FIG. 10 is a block diagram showing an example of a circuit added for making the slur attack rate steeper than the slur decay rate in the example of FIG. 7;

FIG. 11 is a block diagram showing an example of the tone generator in FIG. 2;

FIG. 12 is a diagram showing an example of a tone waveshape to be stored in a waveshape memory in FIG. 11;

FIG. 13 is a block diagram showing a modified example of the tone generator shown in FIG. 11; and FIGS. 14*a*, 14*b* and 14*c* are diagrams schematically showing the problem of the prior art device and solution of the problem by the present invention.

DESCRIPTION OF PREFERRED EMBODIMENTS

FIG. 2 shows an embodiment of the invention applied to a monophonic electronic musical instrument. A tone generator 10 has tone generation channels for two channels for generating a preceding tone and a present tone independently during imparting a slur to them and crossfading the two tones by amplitude-controlling the preceding tone with a decay envelope and amplitude-controlling the present tone with an attack envelope.

A keyboard 11 includes a plurality of keys for designating tone pitches of tones to be generated. A depressed key detection circuit 12 detects depression and release of keys in the keyboard 11 and, if there is a key which has been changed from a released state to a depressed state, produces a key code KC of this particular key and a key-off event signal KOFEV. The outputs of the depressed key detection circuit 12 are applied to a microcomputer section 13. The microcomputer section 13 executes a single tone selection processing for selecting and sounding a single key among plural keys when such plural keys have been depressed in the keyboard 11 and an assignment processing for alternately utilizing the two tone generation channels. The outputs of the microcomputer sectio 13 are supplied to an interface 14 which, responsive to these outputs, produces the key code KC of the tone to be generated, a key-on signal KON, a slur mode signal SLM for controlling an envelope signal during imparting slur and a compulsory damp signal FD. For controlling the period of time during which the slur mode signal SLM is generated, a slur off pulse SLOFP is supplied from an envelope generator 15 to the interface 14.

A pitch information generation and slur imparting circuit 16 receives the key code KC of the tone to be generated provided by the interface 14 and, responsive thereto, generates pitch information SKC representing the pitch of the key represented by the key code KC and, if the slur effect is to be imparted, generates pitch information SKC representing a pitch which changes gradually from the pitch of a first key to the pitch of a second key when the value of the input key code KC has changed from the first key to the second key. The pitch control means which is capable of such pitch varying control for imparting slur, i.e., the pitch information generation and slur imparting circuit 16 can be constructed by employing the technique disclosed by, e.g., Japanese Preliminary Patent Publication No. 107722/1979 and other known techniques so that detailed description of the internal construction of this circuit will be omitted.

A slur control operator 17 includes a slur switch 17*a* for selecting ON-Off of the slur effect and a slur speed selector 17b. The slur control operator 17 effects control as to whether slur is to be imparted or not by supplying the output of the slur switch 17*a* to the microcomputer section 13 and the slur imparting circuit 16 and controls slur speed (i.e., pitch change rate of pitch change time) by supplying the output of the slur speed selector 17*b* to the slur imparting circuit 16. In the present embodiment, slur is not necessarily imparted by turning on the switch 17*a* but whether slur is to be imparted or not is automatically determined depending upon the operation form in depressing the key. More specifically, if the operation form is the legato form when the switch 17*a* is ON, the slur effect is imparted (this will be referred to as "first mode") whereas if the operation form is the staccato form when the switch 17*a* is ON, no slur effect is imparted (this will be referred to as "second mode"). This operation form in depressing the key is judged by the microcomputer section 13 and, when slur is to be imparted, i.e., in the first mode, the slur mode signal SLM provided by the interface 14 is turned to "1". Although this slur mode signal SLM is not applied to the slur imparting circuit 16, the slur imparting circuit 16 judges that slur is to be imparted on the basis of the fact that the output signal of the slur switch 17*a* is ON and that the value of the input key code KC has changed continuously from one key to another and thereupon generates the pitch information SKC indicating the change in the pitch as described above. The ON-OFF selection of the slur effect and the selection of the slur speed need not necessarily be made by the selection operation by means of the exclusive switches 17*a* and 17*b* but may be made automatically in association with the tone color selection by a tone color selection circuit 18.

The tone generator 10 generates tone signals responsive to the pitch information SKC supplied from the slur imparting circuit 16 independently in the two tone generation channels, controls the tone colors and levels of these tone signals respectively in the respective channels and finally adds the tone signals of the two channels together and supplies the result of the addition to a sound system 19. The tone generator 10 includes a tone color control means by which the tone color of the rise portion of tone signals generated in the tone generator 10 is made different between the first mode (i.e., slur is to be imparted) and the second mode (i.e., slur is not imparted). For performing such tone color switching control depending upon the mode, outputs of the microcomputer section 13 are supplied to the tone generator 10 through the interface 14 when such outputs are required.

The envelope generator 15 generates envelope signals VL for two channels (i.e., first and second envelope signals VL1 and VL2) on a time shared basis and supplies them to the tone generator 10. In the respective channels of the tone generator 10, levels and tone colors are controlled in response to the corresponding envelope signals VL. For this purpose, the tone generator 10 includes tone control means (e.g., multiplier for performing the tone amplitude control). The two chanels for generating and controlling tones in the tone generator 10 may be those operating on a time shared basis. The signals KON, SLM and FD for two channels are supplied from the interface 14 to the envelope generator 15 on a time shared basis in accordance with the assignment in the microcomputer section 13 and, responsive to these signals, the envelope signals VL (VL1, VL2) of the respective channels are formed on a time shared basis. Further, the key code KC is supplied from the interface 14 to the envelope generator 15 for key scaling of the envelope signals VL and tone color selection information TC is supplied from the tone color selection circuit 18 to the envelope generator 15 for performing the envelope signal control in accordance with the tone color. Further, for controlling change in the envelope signal VL according to the slur rate, slur speed data SSD is supplied from the slur selector 17*b*. The envelope signal VL is supplied also to the microcomputer section 13.

Figure 3A:
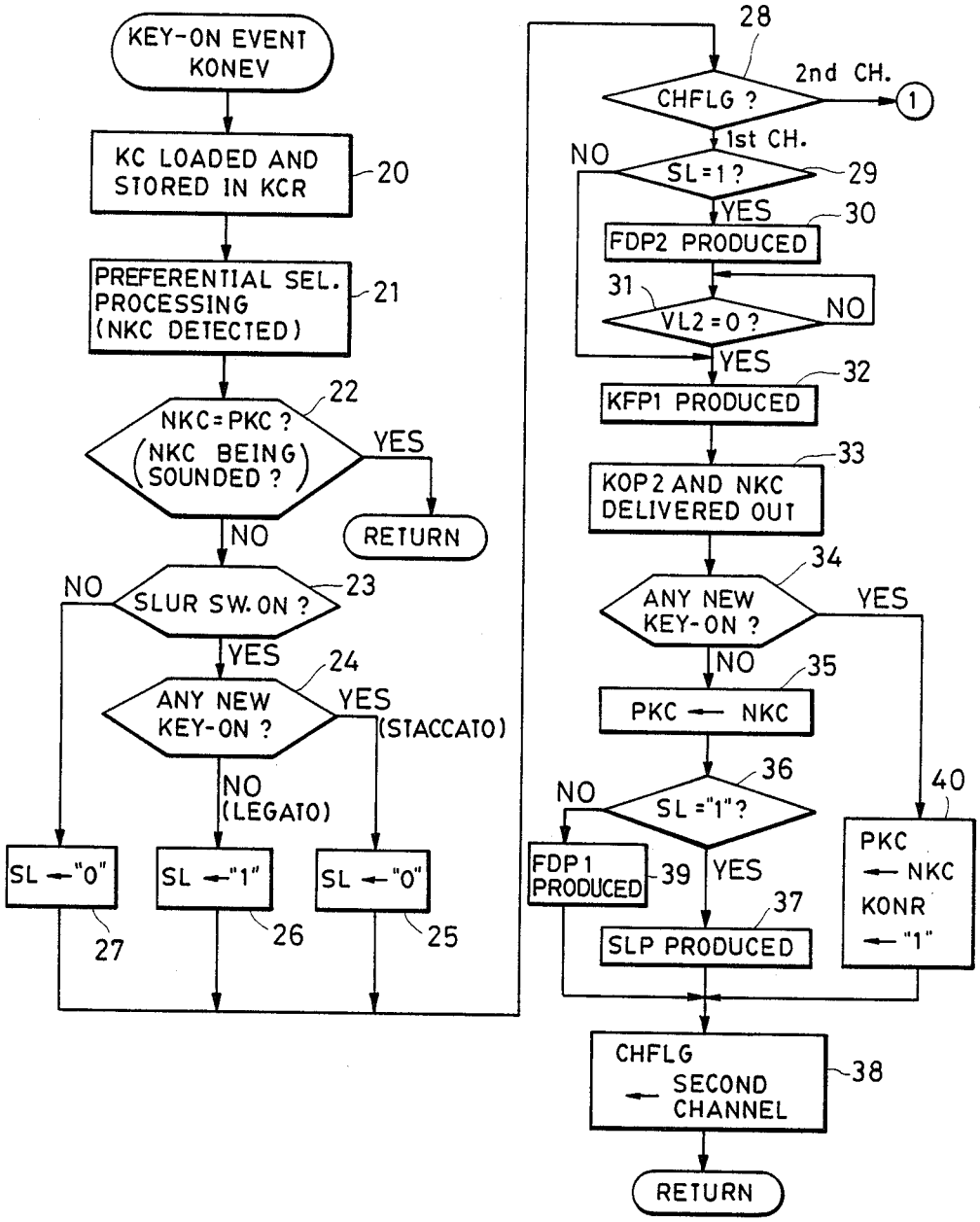
Figure 3B:
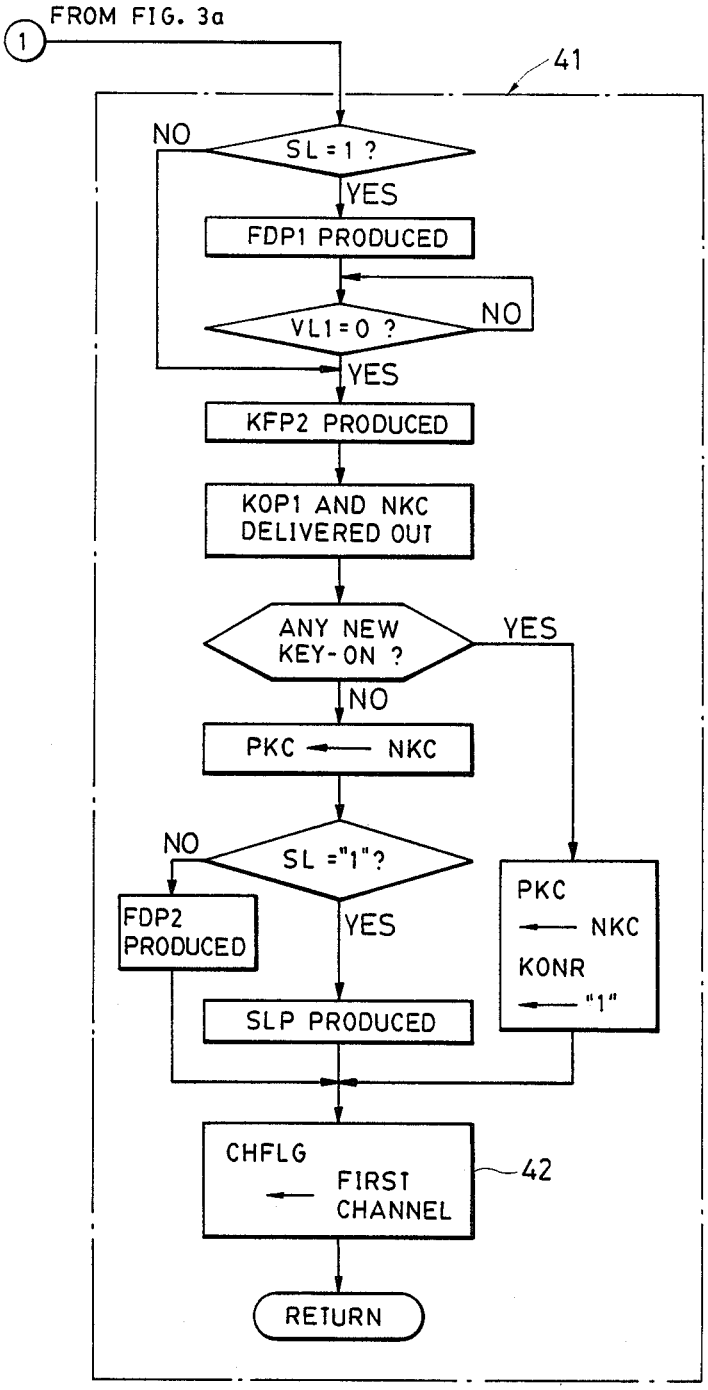
Figure 4:
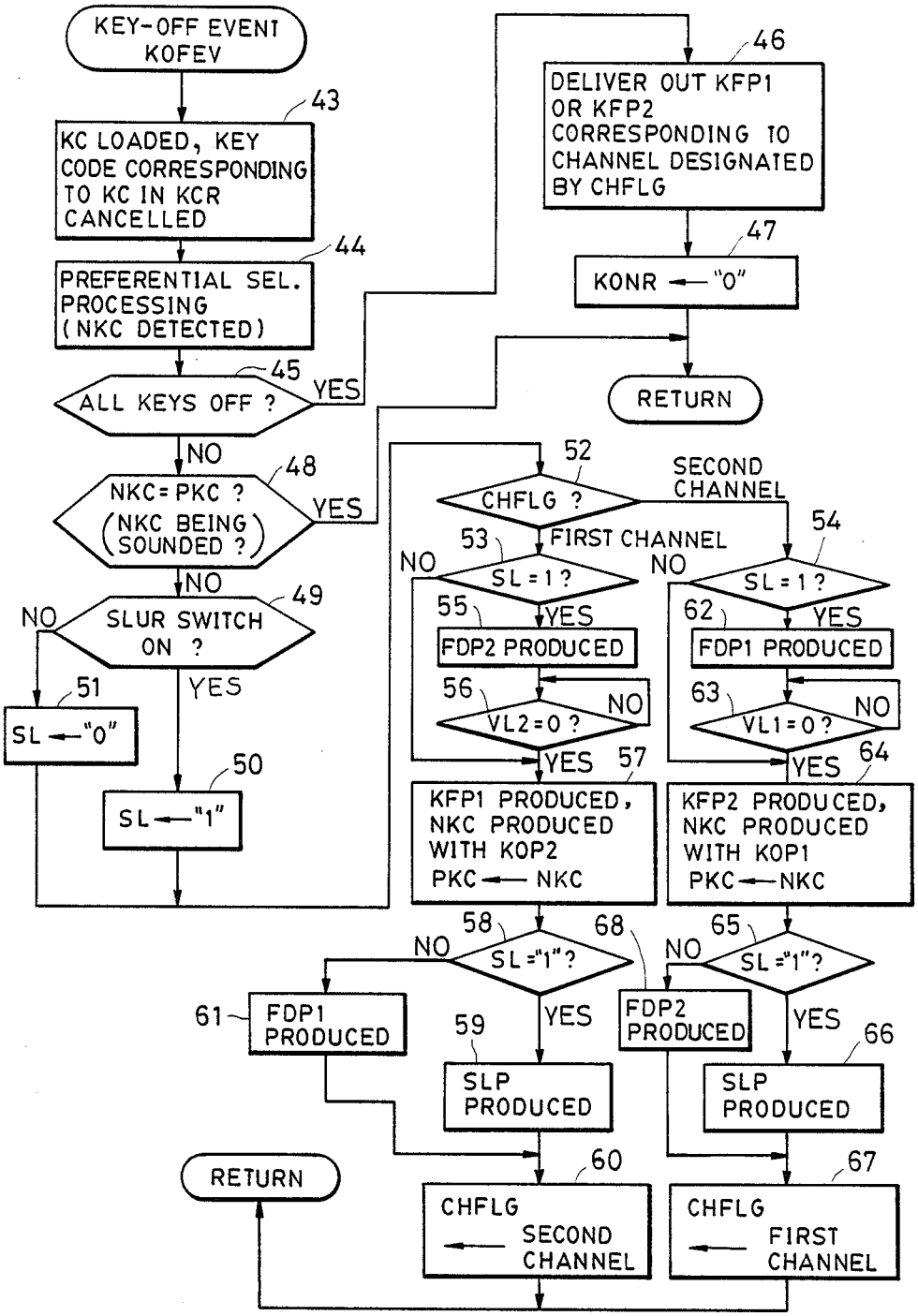
FIG. 4 is a flow chart showing an example of a key-off event program carried out by the microcomputer section.

The microcomputer section 13 executes, upon receipt of the key-on event signal KONEV, a key-on event program as shown in FIGS. 3(*a*) and/or 3(*b*) and, upon receipt of the key-off event signal KOFEV, a key-off event program as shown in FIG. 4.

In the key-on event program, the key code KC supplied from the depressed key depression circuit 12 is loaded with the key-on event signal KONEV in a depressed key code register KCR (block 20). This register KCR has plural memory positions and stores all the key codes KC of keys which are presently being depressed. In block 21, a single key code from among key codes of depressed keys stored in the register KCR is selected in accordance with a predetermined preferential selection standard and stores this key code in an internal register as a preferentially selected key code NKC. For the preferential selection standard, a suitable standard such as the highest note priority, the lowest note priority or later arrived key priority (a key which has been depressed later is given priority) may be adopted. In another internal register, a key code PKC representing a key which is presently being sounded is stored and, in block 22, whether the preferentially selected key code NKC which has been detected in block 21 coincides with the key code PKC of the presently sounded key or not is examined. If they coincide with each other, the rest of the processing is not performed but the program is finished (return). In the case of the later arrived key priority standard is used, block 22 does not usually become YES whereas in the case of the highest note priority standard or the lowest note priority standard is used, the key-on event can occur with respect to keys which have not been preferentially selected so that block 22 can become YES.

When the preferentially selected key code NKC is not presently being sounded, i.e., when the tone to be generated is to be switched from one corresponding to the key code PKC of the tone being presently sounded to one corresponding to the preferentially selected key code NKC, the processing proceeds from NO of block 22 to block 23 and this program is continued. In block 23, whether the slur switch 17*a* is ON or not is examined and, if the switch 17*a* is ON, whether the key-on event this time is any new key-on or not is examined (block 24). The "any new key-on" means a state in which there is no depressed key other than the key which has been depressed this time (i.e., a key has been depressed for the first time in a state in which no key was depressed at all). The any new key-on can be judged by examining whether it is only one key code or two or more key codes that is stored in the depressed key code register KCR. If any new key-on is YES, this means that the key has been depressed in the key operation in the staccato form so that contents of the slur register SL are set to "0" not to impart the slur effect (block 25). Contrarily, if any new key-on is NO, this means that the key has been depressed in the key operation in the legato form so that contents of the slur register SL are set to "1" to impart the slur effect (block 26). If the slur switch 17a is OFF, the slur register SL is set to "0" without making the judgement as to any new key-on (block 27). Thus, by the processings in blocks 23–27, the judgement as to whether slur is to be imparted or not, i.e., the judgement as to whether either the first mode or the second mode has been selected or not, is made.

Channel flag CHFLG indicates which of the two channels generation of the tone has been assigned to. Each time the key to be generated is changed, the channel to which the tone generation is to be assigned is changed alternately. In block 28, which channel the channel flage CHFLG is indicating is examined. If it indicates the first channel, contents of the slur register SL are examined in block 29 and if the contents are "1" (slur is to be imparted, i.e., the first mode has been selected), processings in blocks 30 and 31 are executed and then the program proceeds to block 32. If the contents of the slur register SL are "0" (slur is not imparted, i.e., the second mode has been selected), the program proceeds to block 32, jumping over blocks 30 and 31. In block 30, compulsory damp pulse FDP2 in the second channel is produced. In block 31, whether or not the level of the envelope signal VL2 of the second channel has been reduced to zero in response to the envelope signal VL provided by the envelope generator 15 (FIG. 2) is examined and the program is suspended in this step until the level has been reduced to zero. When the first channel has been detected in block 28, it means that the preceding tone has been assigned to be sounded in the first channel and that the present tone of new key-on should be newly assigned to be sounded in the second channel. For this purpose, the compulsory damp pulse DP2 of the second channel is produced (block 30) and, responsive to this pulse, the level of the envelope signal VL2 of the second channel generated by the envelope generator 15 is forced to be quickly damped to zero if the present level is not zero, whereby the new tone can be assigned to the second channel.

In block 32, the key-off pulse KFP1 of the first channel is produced and, responsive to this pulse, the envelope signal VL1 of the first channel generated by the envelope generator 15 is turned into a decay state. Since in this example the key-off pulse KFP1 and other pulses are produced by decoding, within the interface 14, the address data provided by the microcomputer section 13, the pulse output processing in block 32 and other blocks means not a processing for delivering out a pulse itself from the microcomputer section 13 but a processing for designating an address corresponding to a pulse to be delivered out by writing some data at the address. In this manner, the address code of the designated address is supplied to the interface 14 through the microcomputer section 13 and a desired pulse is derived by decoding this address code.

In block 33, the key-on pulse KOP2 of the second channel and the preferentially selected key code NKC are delivered out. That is to say, as described above, the key code NKC is written at the address corresponding to the pulse KOP2 and its address code is provided to the address bus while the key code NKC is provided to the data bus.

In block 34, whether any new key-on state exists or not is examined again. If the answer is NO, i.e., the legato form key depression operation is being performed, the preferentially selected key code NKC is written in an internal register storing the key code KC of the key which is presently being sounded so as to bring about the state "PKC=NKC" (block 35). Nextly, whether the slur register SL is "1" or not is examined (block 36). If the answer is YES, the slur mode pulse SLP is produced (block 37) and finally the channel flag CHFLG is switched to the contents which indicate the second channel (block 38). If the slur register SL is "0", the program proceeds to block 38 through block 39. In block 39, the compulsory damp pulse FDP1 of the first channel is produced and, responsive this pulse, the level VL1 of the envelope signal of the first channel (i.e., the envelope signal of the preceding sound) is forcibly damped.

If, on the other hand, the any new key-on is YES (i.e., the staccato form key depression operation is being performed), the program proceeds from block 34 to block 40 in which the preferentially selected key code NKC is written in an internal register storing the key code PKC which is presently being sounded and a signal "1" indicating depression of the key is set in the internal key-on register KONR. Then the program proceeds to block 38.

When it has been judged that the channel flag CHFLG indicates the second channel in block 28, routine 41 marked by a chain-and-dot line is executed. In this routine 41, a processing similar to the routing from the above described block 29 to block 38 is executed with respect to the opposite channel. More specifically, processings concerning the pulses or signals FDP2, VL2, KFP1, KOP2, and FDP1 in the routine from block 29 to block 38 (i.e., processings in blocks 30, 31, 32, 33 and 39) are executed with respect to the opposite channels respectively, i.e., the compulsory damp pulse FDP1 of the first channel, the envelope signal VL1, the key-off pulse KFP2 of the second channel, the key-on pulse KOP1 of the first channel and the compulsory damp pulse DFP2 of the second channel. Finally, the channel flag CHFLG is switched to the first channel (block 42).

In the key-off event program shown in FIG. 4, the key code KC supplied from the depressed key detection circuit 12 is loaded with the key-off event signal KOFEV and a key code corresponding to the loaded key code KC in the depressed key code register KCR is cancelled (block 43). In block 44, the same preferential selection processing as in block 21 of FIGS. 3(*a*) and/or 3(*b*) is performed. This is for reviewing the priority order of the key codes in the register KCR, for this priority order may change due to key-off. If all keys are OFF, a predetermined code indicating this state, e.g., a code in which all bits are "0", is stored as the preferentially selected key code NKC. In block 45, whether all keys are off or not is examined. If the result is YES, the key-off pulse KFP1 or KFP2 corresponding to the channel designated by the channel flag CHFLG is delivered out (block 46) and the key-on register KONR is reset to "0" (block 47) thereby ending this program. If all keys are not OFF, whether the condition "NKC=PKC" exists or not is examined and, if the result is YES, it is judged that the present key-off event has not been caused by a key which is being sounded so that the program is ended (i.e., return).

If a key which is being sounded, i.e., a key corresponding to the key code PKC, has become OFF, a newly detected preferentially selected key code NKC and the key code PKC do not coincide with each other and block 48 becomes NO. Next, whether the slur switch 17a is ON or not is examined and, in accordance with result of the examination, the slur register SL is set to "1" or "0" (blocks 49, 50 and 51).

In block 52, the channel flag CHFLG is examined and, in accordance with result of the examination, the program proceeds to either block 53 or 54. When the channel flag CHFLG indicates the first channel, the program proceeds to block 53 and processings similar to those in blocks 29, 30 and 31 in FIG. 3 are performed in blocks 53, 55 and 56. Then, in block 57, the key-off pulse KFP1 of the first channel is produced and then the preferentially selected key code NKC is produced with the key-on pulse KOP2 of the second channel and thereafter NKC is written in the register of PKC. Nextly whether the slur register SL is "1" or not is examined. If the slur register SL is "1", the slur mode pulse SLP is procuded and thereafter the channel flag CHFLG is switched to the second channel (blocks 58, 59 and 60). If the slur register SL is not "1", the slur mode pulse SLP is not produced but the compulsory damp pulse FDP1 of the first channel is produced (block 61) and thereafter CHFLG is switched to the second channel.

On the other hand, if it has been judged that the channel flag CHGLG indicates the second channel in block 52, the program proceeds to block 54. In blocks 54, 62 and 63, processings similar to those in blocks 53, 55 and 56 are executed with respect to the signals FDP1 and VL1 of the opposite channel. Then, in block 64, a processing similar to that in block 57 is executed with respect to the pulses KFP2 and KOP1 of the opposite channels and the key code NKC is delivered out while the key code NKC is written in the register of the pulse PKC. When the slur effect is to be imparted, the slur mode pulse SLP is produced and thereafter the flag CHFLG is switched to the first channel (blocks 65, 66 and 67). When the slur effect is not imparted, the compulsory damp pulse FDP2 of the second channel is delivered out (block 68).

FIG. 5 shows a specific example of the interface 14. Address codes are provided from the microcomputer section 13 to this interface 14 through an address bus 70 in correspondence to output timing of the respective pulses KOP1–SLP. These address codes are decoded on output lines corresponding to output lines corresponding to the respective pulses KOP1–SLP. Data (particularly key code KC) delivered from the microcomputer section 13 with the address codes is latched by a latch circuit 73 through a data bus 72.

The key-on pulse KOP1 and the key-off pulse KFP1 of the first channel are applied respectively to a set input S and reset input R of a flip-flop 74 and an output Q of the flip-flop 74 is supplied to an A input of a selector 75 as the key-on signal KON1 of the first channel. Similarly, the key-on pulse KON2 and the key-off pulse KFP2 of the second channel are respectively applied to a flip-flop 76 and an output Q of the flip-flop 76 is supplied to a B input of a selector 75.

The compulsory damp pulses FDP1 and FDP2 are respectively applied to one-shot circuits 77 and 78. The one-shot circuit 77 produces a shot of pulse FD1 with a pulse width of the channel timing pulse CH1 in synchronism with rising of the pulse FDP1. The one-shot circuit 78 produces a shot of pulse FD2 with a pulse width of an inverted channel timing pulse CH1 in synchronism with rising of the pulse FDP2. The channel timing pulse CH1 is synchronized with the channel time division timing in the tone generator 10 so that it is "1" at the timing of the first channel and "0" at the timing of the second channel. Conversely, the inverted channel timing pulse $\overline{CH1}$ is "0" at the timing of the first channel and "1" at the timing of the second channel. These pulses FD1 and FD2 are multiplexed through an OR gate 79 and a time-division multiplexed damp signal FD is produced.

To the set input S of a flip-flop 80 is applied the slur mode pulse SLP and to its reset input R is applied the slur off pulse SLOFP. The slur mode signal SLM provided by the flip-flop 80 is "1" during a period of time from generation of the slur mode pulse SLP till generation of the slur off pulse SLOFP. A clock pulse $\phi_M$ for synchronizing the operations of the flip-flops 74, 76 and 80 is a high rate pulse synchronized with the clock of the microcomputer section 13.

The latch circuit 73 is latch-controlled by the key-on pulses KOP1 and KOP2 supplied through an OR gate 81. Accordingly, only when the key code NKC has been delivered out with the key-on pulse KOP1 or KOP2 by the processing of block 33 or routine 41 of FIG. 3, contents latched by the latch circuit 73 are rewritten and the key code NKC is latched by the latch circuit 73. The output of the latch circuit 73 is synchronized by the channel timing pulse CH1 through a delay flip-flop 82 and delivered out as the key code KC representing the tone to be generated.

FIG. 6(*a*) shows states of the signals appearing in the respective circuit portions in FIG. 5 in a case where a key KC1 is depressed for the first time at a time point t1, a key KC2 which has preference over the key KC1 is depressed at a time point t2, the key KC2 is released but the key KC1 is kept depressed at a time point t3 and the key KC1 is released at a time point t4. The preferentially selected key code NKC supplied to the data bus 72 exhibits KC1 during the time period from t1 to t2, KC2 during the time period from t2 to t3 and KC1 during the time period from t3 to t4. An example of data in the channel flag CHFLG in the microcomputer section 13 also is shown in FIG. 6(*a*). In this example, it is assumed that CHFLG indicates the first channel prior to the time point t1. In this case, the channel flag CHFLG is switched in such a manner that the second channel is used during the time period t1–t2, the first channel is used during the time period t2–t3 and the second channel is used during the time period t3–t4. In accordance with the contents of the channel flag CHFLG, the key-on pulses KOP1 and KOP2 and the key-off pulses KFP1 and KFP2 of the respective channels are generated at the respective time points t1–t4 as shown in FIG. 6(*a*). Accordingly, the key-on signal KON2 of the second channel is generated during the time period t1–t2.

FIG. 6(*b*) shows states of the damp signal FD, slur mode pulse SLP, slur mode signal SLM and other signals corresponding to FIG. 6(*a*) in the case where the slur switch 17*a* is in an ON state. In this case, it is judged that the any new key-on exists at the time point t1 so that the damp signal FD is not generated. At the time points t2 and t3, it is judged that the key depression in the legato form has been made (the fact that a new preferential key has been depressed in the legato form is detected by the key-on event processing in FIG. 3) and the slur mode pulse SLP is generated. At the time point t2, the compulsory damp pulse FDP1 of the first channel is also generated by the processing of routine 41 in FIG. 3 and, responsive thereto, the pulse FD2 is generated. In response to the slur mode pulse SLP, the slur mode signal SLM is "1" and during this time, the levels of the envelope signals VL1 and VL2 of the first and second channels are changed in crossfading (i.e., one rises while the other falls). The rates of change of the envelope signals during this time are attack rate and decay rate for the slur effect. Upon completion of decay of the envelope signal VL2 or VL1 during the slur period, the slur off pulse SLOFP is generated, the flip-flop 80 (FIG. 5) is reset and the slur mode signal SLM is turned to "0". In the meanwhile, responsive to the change in the key code, the pitch information SLC changes gradually from pitch corresponding to the key code KC1 (or KC2) representing the immediately preceding depressed key to pitch corresponding to the key code KC2 (or KC1) representing the presently depressed key.

FIG. 6(*c*) shows states of the signals corresponding to FIG. 6(*a*) in the case where the slur switch 17*a* is in an OFF state. In this case, the slur mode pulse SLP is not generated. At the time point t2, the compulsory damp pulse FDP2 of the second channel is generated by the processing of routine 41 in FIG. 3 and, responsive thereto, the pulse FD2 is generated. At the time point t3, the compulsory damp pulse FDP1 of the first channel is generated by the processing of block 39 in FIG. 3 and, responsive thereto, the pulse FD1 is generated. Accordingly, within a predetermined period of time from the time point t2, the envelope signal VL2 of the second channel decays quickly at a predetermined damp rate whereas within a predetermined period of time from the time point t3, the envelope signal VL1 of the first channel decays quickly at a predetermined damp rate. The pitch information SKC changes immediately to a pitch corresponding to the tone to be generated.

An example of the envelope generator 15 will now be described with reference to FIG. 7.

A shift register 83 of two stages which is shift controlled by the channel timing pulse CH1 dynamically stores instantaneous values of the envelope signals VL1 and VL2 for the two channels. The output of the shift register 83 is supplied to the tone generator 10 (FIG. 2) as the envelope signal VL (i.e., a time division multiplexed signal of VL1 and VL2). The output of the shift register 83 also is supplied to an operation circuit 84 in which it is subjected to addition or subtraction by change width data $\Delta V$ representing increment or decrement per unit operation time (having a positive or negative sign) supplied through a selector 85. The output of the operation circuit 84 is applied to the shift register 83.

A target value generator 86 supplies data representing a target value TG of the addition or subtraction operation in the loop of the shift register 83 and the operation circuit 84 to A input of a comparator 87. The comparator 87 compares the output signal VL of the shift register 83, i.e., the instantaneous values of the envelope signals VL1 and VL2 of the respective channels, which is applied to B input thereof with the target value TG applied to the A input and produces and output signal according to the relation between values of the two inputs A and B.

A state control section 88 is provided for controlling the state of operation (computation) for forming the envelope signal. For example, this operation state corresponds to typical four portions in the envelope shape, i.e., attack, sustain, decay and damp and two portions specially provided for imparting the slur effect, i.e., slur attack and slur decay. The state control circuit 88 produces a state signal ST designating which of the six portions in the envelope shape is to be formed by the operation in time division multiplexing manner for the respective channels. As to the attack, a normal attack and a slur attack are selectively used, the slur attack being used whtn the slur effect is imparted and otherwise the normal attack being used. As to the decay, a normal decay and a slur decay are selectively used. For effecting the state control, the key-on signal KON, compulsory damp signal FD, slur mode signal SLM and tone color selection information TC for the respective channels supplied from the interface 14 (FIG. 5) on a time shared basis are utilized.

The target value generator 86 prestores level information at changing points of the respective portions of the envelope shape with respect to each tone color and in a state in which it has been key-scaled in accordance with respective keys (or tone ranges) and provides level information at a certain changing point in accordance with the contents of the state signal ST as the target value data TG. Accordingly, the value of this level information differs depending upon the tone color information TC or the key code KC even if the contents of the state signal ST are the same. For convenience of explanation, let it be assumed that the level information, i.e., the target value TG, consists of two kinds of levels, i.e., sustain level and zero level. When the state signal ST is initial state S0, normal decay state S4, damp state S5 or slur decay state S6, the zero level is used as the target value TG whereas when the state signal ST is slur attack state S1, normal attack state S2 or sustain state S3, the sustain level is used as TG. The zero level is irrelevant to the key-scaling and the sustain level only is subjected to the key-scaling.

A change width data generator 89 prestores change width data representing the change rates (inclinations) of the envelope signal in the respective states S0 - S6 with respect to each tone color and in key-scaled values and provides the data in response to the state signal ST, tone color selection information TC and key code KC. For example, change width rate representing an attack rate value is read out in the normal attack state S2, change width rate representing a decay rate value is read out in the normal decay state S4, change rate data representing a damp rate value is read out in the damp state S5 and no change width rate is read out in the other states S0, S1, S3 and S6. The change width data delivered from the generator 89 is intermittently selected by a gate 90 at a predetermined time interval in response to an operation timing signal supplied from an operation timing signal generator 91 and thereafter supplied to A input of the selector 85. It is also possible to control the operation timing with the tone color selection information TC and the state signal ST.

A slur change width data generator 92 generates only slur rates in the slur attack state S1 or the slur decay state S6. The generator 92 generates slur rataes corresponding to the tone color and slur speed and being key-scaled as the change width data in response to the tone color selection information TC, the slur speed data SSD and the key code KC. A slur operation timing generator 93 generates an operation timing signal at a time interval corresponding to the tone color selection information TC and the slur speed data SSD and supplies this timing signal to a gate 95 through an AND gate 94. The AND gate 94 receives, at other input thereof, the slur attack state signal ST1 and the slur decay state signal ST6 through an OR gate 96.

The slur change rate data generated by the generator 92 is applied to B input of a selector 97 and also to a negative conversion circuit 98 in which it is converted to data of negative value. The output of the negative conversion circuit 98 is applied to A input of the selector 97. The selector 97 selects the B input when the slur attack state signal ST1 is "1" and supplies positive change width data to the gate 95 whereas it selects the A input when the slur decay state signal ST6 is "1" and supplies negative change width data to the gate 95. The gate 95 is intermittently opened by the timing signal supplied from the AND gate 94 to supply positive or negative change width data to the B input of the selector 85. The signal ST1 becomes a signal "1" when the state signal ST exhibits the slur attack state S1 and the signal ST6 becomes a signal "1" when the state signal ST exhibits the slur decay state S6. Both signals ST1 and ST6 are generated by the state control circuit 88. Thus, the change width data for the slur attack and the change width data for the slur decay are of the same absolute value and opposite signs. By this arrangement, the slur attack and the slur decay have the same change rate but opposite inclinations.

The selector 85 selects the B input when the output of the OR gate 96 is "1", i.e., in the slur attack state S1 or the slur decay state S6 and selects the A input in other states, i.e., the states S0, S2–S5. Accordingly, the change width data $\Delta V$ representing the slur rate is supplied to the operation circuit 84 in the slur attack state S1 or the slur decay state S6 and, in other states, the change width data $\Delta V$ provided by the generator 89 through the gate 90 is supplied to the operation circuit 84.

FIG. 8 shows an example of the state changing operation for one channel in the state control circuit 88. The same operation is performed for two channels on a time shared basis. The changing operation initially is set to the initial state S0 (block 100). If the slur mode signal SLM is "1" when the key-on signal KON has risen to "1", the state is changed to the slur attack state S1 whereas if the slur mode signal SLM is "0", the state is changed to the normal attack state S2. In the state S1 or S2, the level of the envelope signal VL increases in accordance with the slur rate or attack rate, the sustain level being used as the target value TG. As the condition "VL=TG" is brought about (YES in block 101), the state is changed to the sustain state S3. In this state S3, whether the tone color selection information TC exhibits the tone color of the sustain tone or not is examined (block 102). If the result is YES, this state S3 is maintained to maintain the envelope signal VL in the sustain level. If the result is NO, the program proceeds to block 103 in which the state is changed to the normal decay state S4 or the slur decay state S6. If the key-on signal KON is changed to "0" in the state S3, the program proceeds from NO of block 104 to block 103 in which the state is changed to the decay state S4 or S6.

In the normal decay state S4, the level of the envelope signal VL decreases in accordance with the decay rate. As the envelope signal VL has been reduced to the zero level (YES in block 105), the state is changed to the initial state S0. In the slur decay state S6, the level of the envelope signal VL decreases in accordance with the slur rate. As the envelope signal VL has been reduced to the zero level, the program proceeds from YES in block 106 to block 107 in which the slur off pulse SLOFP is produced and thereafter the state is changed to the initial state S0.

In the midst of the respective states S1–S4 and S6, whether the compulsory damp signal FD has become "1" or not is examined (blocks 108, 109, 110 and 111). If the result is YES, the state is changed to the damp state S5. In this damp state S5, the level of the envelope signal VL decreases in accordance with the damp rate and, when the envelope signal VL has been reduced to the zero level (YES in block 112), the state is changed to the initial state S0. Typically, the normal attack rate is faster than the slur attack rate, the normal decay rate is slower than the slur decay rate and the damp rate is faster than the decay rates.

Reverting to FIG. 6 (*b*), description will be made about the envelope signal VL (i.e., VL1 and VL2) and pitch information SKC corresponding to FIG. 6(*a*) in the case where the slur switch 17*a* is in an ON state. In the time period t1–t2, the envelope signal VL2 of the second channel rises with the normal attack rate and thereafter maintains a sustain level L1 corresponding to a key KC1. In the meanwhile, the pitch information SKC maintains a constant pitch corresponding to the key KC1. Upon generation of the key-on pulse KOP1 of the first channel, the key-off pulse KFP2 of the second channel and the slur mode signal SLP at the time point t2, the key-on signal KON1 of the first channel is turned to "1", the key-on signal KON2 of the second channel to "0" and the slur mode signal SLM to "1" respectively. Block 103 in FIG. 8 concerning the second channel thereby becomes YES and the slur decay state S6 is brought about. Simultaneously, block 113 in FIG. 8 concerning the first channel becomes YES and the slur attack state S1 is brought about. Accordingly, the envelope signal VL1 decays with the slur rate and the envelope signal VL2 rises with the slur rate. In the meanwhile, contents of the key code KC are changed from KC1 to KC2 at the time point t2 and the pitch information SKC thereby is changed gradually from a pitch corresponding to the key KC1 to a pitch corresponding to the key KC2 whereby the slur effect is imparted. In this slur imparting period, the slur decay portion of one envelope signal VL1 crosses with the slur attack portion of the other envelope signal VL2. Upon completion of the slur decay of the second channel, block 106 in FIG. 8 becomes YES and the slur off pulse SLOFP is produced in block 107. The flip-flop 80 of FIG. 5 thereby is reset and the slur mode signal SLM is turned to "0". During the time period t3–t4, the same operation as in the time period t2–t3 is performed with respect to the opposite channel. Since the slur mode signal SLM is not turned to "1" at the time point 4, block 103 in FIG. 8 becomes NO and the normal decay mode S4 is brought about and the envelope signal VL2 decays with the normal decay rate.

Referring to FIG. 6(*c*), description will be made about the envelope signal VL (i.e., VL1 and VL2) and the pitch information SKC corresponding to FIG. 6 (*a*) in the case where the slur effect is not imparted. In this case, the key-off pulse KFP2 of the second channel is generated at the time point t2 and, simultaneously therewith the compulsory damp pulse FDP2 is generated by the processing of routing 41 in FIG. 3. Block 109 of FIG. 8 concerning the second channel thereby becomes YES and the damp state S5 is brought about. Since the slur mode pulse SLP is not generated at this time, the slur mode signal SLM is "0" and block 113 in FIG. 8 concerning the first channel becomes NO whereby the normal attack state S2 is brought about. The envelope signal VL2 therefore decays quickly with the damp rate and the envelope signal VL1 rises with the normal attack rate. At the time point t3, the same operation is performed with resepct to the opposite channel. Since the time points t2 and t3 are depressed key changing points in the legato form, the damp pulses FDP1 and FDP2 are generated. At the time point t4 which is for the normal release of the key, the damp pulse FDP2 is not generated. Accordingly, the envelope signal VL2 decays with the normal decay rate at the time point t4. At the time points t2 and t3, the pitch information SKC is changed suddenly from KC1 to KC2 or from KC2 to KC1. As will be noted from the above, the provision of the damp period for the preceding tone in the legato form change in the depressed key is preferable even when the slur effect is not imparted, for changing from the preceding tone to the new tone can thereby be emphasized.

No particular correlation needs to be provided between changing points (A, B, C, D, E and F in FIG. 6 (b)) of the envelope signal VL and the pitch information SKC in the slur imparting period (this term is used to designate not only a period during which the pitch is actually undergoing the slur change but an entire period during which the operation for the slur change is performed) but such changing points may be located as freely as desired. It is, however, generally preferabale that the point A at which the envelope of the preceding tone starts decay should correspond to the changing time point t2 of the key code NkC and that the point E at which the pitch information SKC starts the slur change should correspond to the point B at which the envelope of the new tone starts rising. The other points B, C, D and F may be established entirely freely. By variably controlling these points B, C, D and F, the synthesized envelope for the tone control by the two envelope signals in the slur imparting period (i.e., the synthesized envelope from the key-scaled first level L1 to the key-scaled second level L2) can be readily formed to various characteristics.

According to the embodiment of FIG. 7, the change rate of the slur attack is the same as the change rate of the slur decay so that the envelope signals VL1 and VL2 of the respective channels are of completely opposite characteristics as shown in FIG. 9(*a*) and a synthesized level (VL1+VL2) is arithmetically expected to be flat as shown by a dotted line in FIG. 9(*a*). In hearing the actually sounded tone, however, the synthesized level seems to drop slightly in a crossing section of the two envelope signals as shown by a dotted line in FIG. 9(*b*). Since such drop in the tone level in the slur imparting period is not desirable, the slur attack rate may be made of a sharper inclination than the slur decay rate as shown by a chain-and-dot line in FIG. 9(*c*) so as to reinforce the synthesized level. For this purpose, the slur speed data SSD to be supplied to the slur change width data generator 92 and/or the slur operation timing generator 93 may be changed by change rate establishing means 118 as shown in FIG. 10 and changed data SSD' may be supplied instead of the data SSD to the generator 92 and/or the generator 93.

The change rate establishing means 118 establishes the slur attack rate in a larger rate than the slur decay rate and obtains different change rates by differring the value of the slur speed data SSD in the slur attack from that in the slur decay. More specifically, the slur speed data SSD is not applied directly to the slur change width data generator 92 and the slur operation timing generator 93 but applied to the change rate establishing means 118 in which its value is controlled depending upon whether it is the slur attack period or slur decay period and the controlled slur speed data SSD' is applied to the respective generators 92 and 93 of FIG. 7.

In the change rate establishing means 118, a predetermined compensation value (this compensation value may be varied in accordance with the tone color selection information TC) is generated by a compensation value generation circuit 115 and this compensation value is added to the slur speed data SSD by an adder 116. The output of the adder 116 is applied to A input of a selector 117 and the slur speed data SSD is applied to B input thereof. The selector 117 selects the A input when a slur attack state signal ST1 is "1" and the B input when a slur decay state signal ST6 is "1". The output of the selector 117 is applied as the compensated slur speed data SSD' to the slur change width data generator 92 and/or the slur operation timing generator 93 in FIG. 7 so that the value of the slur change width data and/or the period of the operation timing signal generated by the generators 92 and 93 are controlled in response to the data SSD'. During the slur attack period, the data SSD added with the compensation value is selected by the selector 117 as the data SSD'. During the slur decay period, the data SSD itself is selected by the selector 117 as the data SSD'.

As described previously, in FIG. 7, the slur change widht data generated by the generator 92 is supplied to the B input of a selector 97 and also to a negative conversion circuit 98 in which it is converted to data of the negative sign. The output of the negative conversion circuit 98 is supplied to the A input of a selector 97. The selector 97 selects the B input when the slur attack state signal ST1 is "1", supplying the negative change width data to a gate 95. The gate 95 is intermittently opened by a timing signal provided by an AND gate 94 to supply the positive or negative change width data to the B input of the selector 85. Thus, the change width data for the slur attack and the change width data for the slur decay are of opposite signs to each other and therefore the slur attack and the slur decay have opposite inclinations.

During the slur attack, the data SSD' obtained by increasing the slur speed data SSD by the change rate establishing means 118 of FIG. 10 is supplied to the generator 92 and/or the generator 93 and, accordingly, the value of the change width data generated by the generator 92 and/or the generator 93 is increased (or the period of the operation timing signal becomes shorter). On the other hand, during the slur decay, the slur speed data SSD is supplied directly to the generators 92 and 93 and, accordingly, the value of the change width data generated by the generators 92 and 93 is decreased (or the period of the operation timing signal becomes longer). The change rate of the envelope signal level during the slur attack therefore becomes faster than that during the slur decay so that, as shown in FIG. 9(*c*) or by a chain-and-dot line in FIG. 6(*b*), the rise of the slur attack envelope can be more sharp than the fall of the slur decay.

In FIG. 10, the slur attack rate is made faster than the slur decay rate by increasing the value of the slur speed data SSD during the slur attack. The means for making the slur attack rate faster is not limited to this but any means that can make the slur attack rate faster than the slur decay rate may be adopted. For example, the change width data generated by the slur change width data generator 92 may be increased during the slur attack by using a circuit similar to the change rate establishing means 118. The compensation of the data is made not only by increasing the slur attack rate but also be decreasaing the slur decay rate.

FIG. 11 shows an example of the tone generator 10. In this example, a tone signal is generated by reading out a tone waveshape stored in a waveshape memory 120. More specifically, the waveshape memory 120 stores tone waveshape data with respect to M kinds of tone colors from tone color 1 to tone color M as shown in FIG. 12. Tone waveshape data for N key ranges from 1 to N are stored with respect to one tone color kind and tone waveshape data of an attack (rise) portion and a sustain portion are stored with respect to one key range. For example, the stored tone waveshape data of the attack portion consists of tone waveshape data of continuous plural periods in a rise portion of a normal tone, its amplitude envelope is standardized to become a predetermined level and the tone color characteristics of this tone waveshape correspond to the tone color characteristics peculiar to the rise portion of a normal tone. For another example, the stored tone waveshape data of the sustain portion of the tone consists of tone waveshape data of plural periods in a sustain portion of a tone and its tone characteristics are different from the tone characteristics of the tone waveshape of the rise portion. Since the amplitude envelope of the sustain portion originally is of a constant level, no particular level standardization is necessary in storing waveshape data. The level standardization may however be performed with respect to the sustain portion also.

Tone waveshape data of the respective key ranges for the respective tone color kinds are respectively stored at different absolute addresses in the waveshape 120. For example, tone waveshape data of the attack portion of the key range 1 for the tone color 1 is stored at addresses from an attack start address AS1 to an attack end address AE1 and tone waveshape data of the sustain portion is stored at addresses from a repeat start address RS1 to a repeat end address RE1. With respect to other key ranges also, tone waveshape data of the attack portion are stored at attack start addresses AS2, ASn to attack end addresses AE2, AEn and tone waveshape data of the sustain portion are stored at repeat start addresses RS2, RSn to repeat end addresses RE2, REn.

In FIG. 11, to latch circuits 121 and 122 is supplied the key code NKC from the microcomputer section 13 (FIG. 2) through a data bus 72. The latch circuit 121 is latch-controlled by the key-on pulse KOP1 of the first channel and the latch circuit 122 by the key-on pulse KOP2 of the second channel. The key code of a key assigned to the first channel therefore is latched in the latch circuit 121 and the key code of a key assigned to the second channel is latched in the latch circuit 122. Key range detection circuits 123 and 124 receive output key codes of the latch circuits 121 and 122 and thereupon detect key ranges to which the keys corresponding to the key codes belong. If division of a key range differs depending upon the tone color kind, the tone color selection information TC is applied to the respective key range detection circuits 123 and 124 so as to detect the key ranges of the depressed keys in accordance with the manner of division corresponding to the selected tone color kind.

The key range detection circuits 123 and 124 produce key range codes representing the detected key ranges and supply them to a selector 125. The selector 125 selects, in response to the channel timing pulse CH1, a key range code (output of the circuit 123) of a key assigned to the first channel at a time division timing of the first channel and a key range code (output of the circuit 124) of a key assigned to the second channel at a time division timing of the second channel. Thus, the time division multiplexed key range codes KS of the respective channels are delivered out of the selector 125 in accordance with the channel time division timing. The key range codes KS are supplied to an attack start address generation circuit 127, an attack end detection circuit 128 and a repeat end detection circuit 129.

The attack start address generation circuit 126 generates, responsive to the applied key range code KS and the tone color selection information TC, attack start address data AS representing an attack start address corresponding to the key range of the depressed key of the selected tone color kind (e.g., AS1 in the case of the key range 1 of the tone color 1). The repeat start address generation circuit 127 generates, responsive to the applied key range code KS and the tone color selection information TC, repeat start address data RS representing a repeat start address corresponding to the key range of the depressed key of the selected tone color kind (e.g., RS1 in the case of the key range 1 of the tone color 1). The data AS and RS for two channels are generated on a time shared basis in response to the time division multiplexed key range codes KS of the respective channels.

The data AS is supplied to A input of a selector 130 and the data RS is supplied to B input thereof. Either input is selected and supplied to an adder 131. The adder 131 receives at the other input thereof phase angle data which changes timewise at a rate corresponding to the pitch information SKC (i.e., relative address data for accessing the waveshape memory) which is supplied from a phase accumulator 132. This phase angle data and the start address data AS or RS are added together and address data representing an absolute address of tone waveshape data for one sample point to be read out from the waveshape memory 120 is provided by the adder 131.

In the waveshape memory 120, tone waveshape data for each sample point is read out in response to the address data supplied from the adder 131 and the read out data is supplied to a multiplier for imparting an envelope. The multiplier 133 controls the amplitude level of the tone waveshape data by the envelope signal VL.

The attack end detection circuit 128 specifies, responsive to the applied key range codes KS and the tone color selection information TC, the attack end address (e.g., AE1 in the case of the key range 1 of the tone color 1) and detects this attack end address when the present value of the address data supplied from the adder 131 coincides with the attack end address. Upon detection of the attack end address, the circuit 128 produces a signal "1" as an attack end detection signal AED. The repeat end detection circuit 129 specifies, responsive to the applied key range codes KS and the tone color selection information TC, the repeat end address (e.g., RE1 in the case of the key range 1 of the tone color 1) and detects this repeat end address when the present value of the address data of the adder 131 coincides with the repeat end address. Upon detection of the repeat end address, the circuit 129 produces a signal "1" as a repeat end detection signal RED. Instead of the output of the adder 131, the output of a phase accumulator 132 may be applied to the detection circuits 128 and 129 as shown by dotted lines so that detection of the attack end or repeat end may be performed.

The phase accumulator 132 comprises a shift register 134 of two stages which is shift-controlled by the channel timing pulse CH1, an adder 135 which adds the output of the shift register 134 and the pitch information SKC together and a gate 136 which performs as to whether the output of the adder 135 is to be applied to the input of the shift register 134, and accumulates the pitch information SKC in two channels on a time shared basis.

The key-on signals KON1 and KON2 of the respective channels produced by the flip-flop 74 and 76 in FIG. 5 are applied to one-shot circuits 137 and 138 of FIG. 11. The one-shot circuit 137 produces one shot of key-on pulse with a pulse width of the channel timing pulse CH1 (i.e., at a time slot of the first channel) in synchronism with the rising of the signal KON1. The one-shot circuit 138 produces one shot of pulse of key-on pulse with a pulse width of an inverted channel timing pulse $\overline{CH1}$ (i.e., at a time slot of the second channel) in synchronism with the rising of the signal KON2. These key-on pulses and the attack end detection signal AED and the repeat end detection signal RED are applied to an OR gate 139 and a signal derived by inverting the output of the OR gate 139 is applied to a control input of the gate 136. Accordingly, when generation of a new tone is to be started in the first channel or the second channel, the output of the one-shot circuit 137 or 138 becomes "1" and this signal is inverted by an inverter 140 and the gate 136 thereby is closed. The old operation result in this channel in the phase accumulator thereby is cleared and accumulation of the pitch information SKC of a tone to be generated anew is started. When the attack end detection signal AED or the repeat end detection signal RED has been generated, the old operation result of this channel in the phase accumulator 132 likewise is cleared and accumulation of the pitch information SKC is started anew.

When the selector 130 has selected the attack start address data AS, the address data supplied from the adder 131 to the waveshape memory 120 successively changes at a rate corresponding to the pitch information SKC using the attack start address as an initial value. The tone waveshape data of the attack portion is sequentially read out from the waveshape memory 120.

When the selector 130 has selected the repeat start address data RS, the address data supplied from the adder 131 to the waveshape memory 120 successively changes at a rate corresponding to the pitch information SKC using the repeat start address as an initial value. The tone waveshape data of the sustain portion therefore is sequentially read out from the waveshape memory 120.

The selective change in the selector 130 is performed by a waveshape change control section 141 including a selector 142, flip-flops 143 and 144, AND gates 145 and 146, and OR gates 147 and 148. This waveshape change control section 141 performs a function for effecting a timewise waveshape change control in such a manner that, during the normal tone generation, the tone waveshape of the sustain portion is read out after the tone waveshape of the attack portion is read out and also a function as "tone color control means" for causing the tone color of the rise portion of the tone to differ between the slur mode and the non-slur mode by reading out the tone waveshape of the sustain portion from the beginning instead of reading out the tone waveshape of the attack portion in the slur mode.

To set inputs S of the flip-flops 143 and 144 are applied the key-on pulses KOP1 and KOP2 provided by the decoder 71 of the interface 14 (FIG. 5). To reset inputs R of the flip-flops 143 and 144 are applied the key-off pulses KFP1 and KFP2, the slur mode pulse SLP and the output signals of the AND gates 145 and 146 through OR gates 147 and 148. The channel timing pulse CH1 is applied to the AND gate 145 and the inverted channel timing pulse $\overline{CH1}$ is applied to the AND gate 146. The attack end detection signal AED is applied to other inputs of the respective AND gates 145 and 146. The output of the flip-flop 143 is applied to A input of the selector 142 and the output of the flip-flop 144 is applied to B input of the selector 142. The selector 142 selects the A input when the channel timing pulse CH1 is "1" and the B input when the pulse CH1 is "0". The output signal of the selector 142 is applied to the selection control input of the selector 130. When the output signal of the selector 142 is "1", the selector 130 selects the A input, i.e., the attack start address data AS and when it is "0", the selector 130 selects the B input, i.e., the repeat start address data RS.

In a normal mode in which no slur is imparted (i.e., the second mode), the flip-flop 143 or 144 is set in response to generation of the key-on pulse KOP1 or KOP2. This output signal "1" of the flip-flop 143 or 144 is selected by the selector 142 on a time shared basis thereby causing the selector 130 to select the A input. Accordingly, the attack start address data AS initially is selected and applied to the adder 131. In response to this, the tone waveshape data of the attack portion is read out from the waveshape memory 120 as described before. Upon completion of reading out of the attack portion, the attack end detection signal AED becomes "1". If this signal AED has been turned to "1" a the timing of the first channel, the AND gate 145 produces a signal "1" thereby resetting the flip-flop 143. If the signal AED has been turned to "1" at the timing of the second channel, the AND gate 146 produces a signal "1" thereby resetting the flip-flop 144. Upon resetting of the flip-flop 143 or 144, its output signal "0" is supplied to the selector 130 through the selector 142 at a corresponding channel timing thereby causing the selector 130 to select the B input. Thus, after the completion of reading of the attack portion, the repeat start address data RS is selected and, as described previously, the phase accumulator 132 resumes accumulation of the pitch information SKC after being once cleared. The tone waveshape data of the sustain portion thereby is read out from the waveshape memory 120. Upon completion of readout of the sustain portion, the repeat end detection signal RED is turned to "1" and, as described previously, the phase accumulator 132 is once cleared and thereafter resumes accumulation of the pitch information SKC. In the meanwhile, the repeat start address data RS continues to be selected by the selector 130. In the foregoing manner, when the sustain portion is read out, the address data read out from the adder 131 sequentially changes from the repeat start address to the repeat end address and returns to the repeat start address upon reaching the repeat end address, repeating this change again and again. In the normal tone generation, the tone waveshape of the attack portion is once read out and then the tone waveshape of the sustain portion is repeatedly read out. In a case where the key-off pulse KFP1 or KFP2 is generated before the end of the attack portion, the flip-flop 143 or 144 is reset before generation of the attack end detection signal AED and the sustain portion thereafter is read out.

In the slur mode (the first mode), the slur mode pulse SLP is generated simultaneously with the key-on pulse KOP1 or KOP2 (FIG. 6(b)). The flip-flops 143 and 144 are of a reset preference type and they are set to a reset state by applying a signal "1" to their reset inputs R through OR gates 147 and 148. This causes the selector 130 to select the repeat start address data RS from the beginning. In the slur mode, therefore, the tone waveshape of the normal attack portion is not read out but the tone waveshape of the sustain portion is read out from the beginning. While the tone waveshape of the sustain portion is read out at the rising of the tone in the foregoing manner, the pitch information SKC is gradually changed from a value corresponding to the preceding tone to a value corresponding to a new tone and corresponding pitch change is imparted to the tone. Thus, the tone color of the tone waveshape which rises with the slur type pitch change is not the tone color of the normal attack portion but is the tone color of the sustain portion.

In the embodiment of FIG. 11, the tone color of the sustain portion is used as the tone color of the attack portion of a tone in the slur mode. The tone color is not limited to this but a tone color used exclusively for the slur mode may be used. FIG. 13 shows an example of the latter case in which the same circuit as shown in FIG. 11 are designated by the same reference numerals. A waveshape memory 120' stores, for each key range of each tone color kind, not only tone waveshape of an attack portion and a sustain portion but also a tone waveshape of an attack portion consisting of plural periods used exclusively for the slur mode.

The storage of the tone waveshape of the attack portion used exclusively for the slur mode is accompanied by provision of a slur start address generation circuit 149 and a slur end detection circuit 150. The circuit 149 generates data SLS representing the initial address of the tone waveshape of the attack portion used exclusively for the slur mode, i.e., slur start address in response to the key range code KS and the tone color selection information TC. The circuit 150 specifies the last address of the tone waveshape of the attack portion used exclusively for the slur mode, i.e., slur end address is response to the key range code KS and the tone color selection information TC and produces a slur end detection signal SED when the input address data in the memory 120' has reached the slur end address. This slur end detection signal SED is applied to the OR gate 139 with other signals AED and RED and also applied, like the signal AED, to the AND gates 145 and 146 through an OR gate 151.

Tone color control means 152 includes a selector 153, a flip-flop 154, AND gates 155, 156 and 157 and an OR gate 158. The flip-flop 154 is set by the slur mode pulse SLP and reset by the slur end detection signal SED. The output of the flip-flop 154 is applied to the AND gate 155 and the output of the AND gate 155 in turn is applied to a control input of the selector 153. When the output signal of the AND gate 155 is "0", the selector 153 is caused to select a B input thereby selecting the attack start address data AS provided by the circuit 126 and supplying this data to the A input of the selector 130. When the output signal of the AND gate 155 is "1", the selector 153 is caused to select an A input thereby selecting the slur start address data SLS provided by the circuit 149 and supplying this data to the A input of the selector 130. A signal derived by inverting the channel flag pulse CHFLG and the channel timing pulse CH1 are applied to an AND gate 156 whereas a signal corresponding to the channel flag CHFLG and a signal derived by inverting the channel timing pulse CH1 are applied to an AND gate 157. The channel flag CHFLG is "0" when it represents the first channel and "1" when it represents the second channel. The outputs of the AND gates 156 and 157 are applied to another input of the AND gate 155 through an OR gate 158. When the slur mode pulse SLP has been generated, the flip-flop 154 is set and, if this slur mode pulse SLP has been generated in the first channel, the channel flag CHFLG is "0" so that the AND gate 156 is enabled and the AND gate 155 is enabled on a time shared basis at a time slot of the first channel in response to the pulse CH1. If the pulse SLP corresponds to the second channel, the channel flag CHFLG is "1" so that the AND gate 157 is enabled and the AND gate 155 is enabled on a time shared basis at a time slot of the second channel in response to the inverted signal of the pulse CH1. Thus, the AND gate 155 is enabled on a time shared basis in correspondence with the channel of the tone rise in the slur mode thereby gating out the output of the flip-flop 154 to the selector 153.

During the normal rising of a tone, the output of the AND gate 155 is "0" so that the selector 153 selects the attack start address data AS. Accordingly, in the same manner as was previously described, the tone waveshape of the attack portion is read out in the rising of the tone.

In the slur mode, the flip-flop 154 is set by the pulse SLP and the output of the AND gate 155 becomes "1" at a timing of the channel to which a tone to rise in the slur mode is assigned. The selector 153 thereby selects the slur start address data SLS at this channel timing so that reading of the tone waveshape of the attack portion used exclusively for the slur mode is started. Upon completion of one cycle of reading of this tone waveshape, the slur end detection signal SED is generated and the flip-flop 154 is reset. The flip-flop 143 or 144 also is reset through the OR gate 151 and the AND gate 145 or 146. The selection 130 therefore is switched to select the B input, selecting the repeat start address data RS. In this manner, in the slur mode, the tone waveshape of the attack portion used exclusively for the slur mode is initially read out and then, in the same manner as previously described, the tone waveshape of the sustain portion is repeatedly read out.

In the above embodiment, the level of a tone waveshape stored in the waveshape memory 120 or 120' is standardized to a certain level. Alternatively, a tone waveshape imparted previously with a predetermined attack envelope may be stored in these memories. For storing tone waveshape data of the sustain portion, a technique for smoothing the connection between the end portion and the start portion of repeatedly read out sustain portion waveshapes such as one disclosed in Japanese Preliminary Patent Publication 18697/1984 may be employed. The tone waveshape of the sustain portion to be stored in the memory need not be waveshape of plural periods but it may be one period or less than one period such as a half period. In the above embodiments, different tone waveshapes are stored for respective key ranges. Alternatively, different tone waveshapes for may be stored for respective keys. Further, if key scaling of the tone color is not performed, a tone tone waveshape common to all keys may be stored.

Instead of storing all waveshape data of respective sample points of a waveshape to be stored, waveshape data of skippingly selected sample points only may be stored and waveshape data of omitted sample points may be computed by interpolation operation. The waveshape of plural periods to be stored in the waveshape memory need not necessarily be of continuous plural periods but may consist of skippingly selected plural periods. For example, an arrangement may be made so that a tone waveshape from attack to decay is divided into plural frames, waveshape data of representative one period or two periods only in each frame is stored and waveshape data of each frame is read out sequentially and repeatedly. In this case, the connecting portion between the preceding waveshape and the next waveshape occurring in the switching of the waveshape data may be interpolated according to necessity so as to form a smoothly changing waveshape data.

The coding form of waveshape data to be stored in the waveshape memory is not limited to the pulse code modulation (PCM) system but it may be other suitable system selected from systems such as the difference PCM system, the delta modulation (DM) system, the adaptive type PCM (ADPCM) system and the adaptive type delta modulation (ADM) system etc.

The two tone generation channels may be formed in parallel instead of being formed on a time shared basis. Further, in the above embodiments, the preceding tone and the new tone are generated in different channels in the slur mode and attack and decay envelopes of the two tones are caused to crossfade. The invention, however, is applicable also to a case in which the slur effect is imparted using only one channel.

The tone generation system in the tone generator 10 is not limited to the simple waveshape reading system as described above but other suitable system selected from systems such as the harmonics synthesis system, the frequency modulation system, the amplitude modulation system and the digital filter system may be employed. In this case, the tone color switching control in the attack portion of the tone can be performed by controlling operation parameters such as harmonic coefficients or modulation index or filter coefficients.

The invention is applicable not only to a monophonic type electronic musical instrument but also to a polyphonic type electronic musical instrument.

According to the present invention, the tone color of the attack portion of a tone is made different depending upon whether the pitch change is imparted to the tone or not so that a tone color change peculiar to slur in a natural musical instrument can be realized.

Further, according to the present invention, a tone signal is controlled in two channels, a control signal of one channel and a control signal of the other channel are caused to change in opposite characteristics during a pitch imparting period and the rate of change of the control signal of the attack characteristics is made greater than the rate of change of the control signal of the decay characteristics whereby, when these control signals are used for the tone level control, the auditory impression of the tone level drop in the crossing section of the changing control signals can be sufficiently compensated.

We claim:

1. An electronic musical instrument comprising:

mode selection means for selecting one of a plurality of performance modes including at least a first mode and a second mode;

tone generation means for generating a tone signal representative of a tone to be generated;

pitch control means (a) for gradually changing the pitch of said tone to be generated from a first pitch to a second pitch during an attack portion of said tone when said first mode is selected by said mode selection means and (b) for causing the pitch of said tone to be generated to be equal to said second pitch during said attack portion of said tone when said second mode is selected by said mode selection means; and tone color control means for imparting a first tone color to said attack portion of said tone when said first mode is slected and for imparting a second tone color to said attack portion of said tone when said second mode is selected, the second tone color being different from said first tone color.

2. An electronic musical instrument as defined in claim 1 wherein said tone generation means is capable of selectively generating an attack waveshape and a sustain waveshape as a part of said tone signal, and said tone color control means generates said sustain waveshape in said attack portion of said tone when said first mode is selected and generates said attack waveshape in said attack portion of said tone when said second mode is selected.

3. An electronic musical instrument as defined in claim 1 wherein said tone generation means is capable of selectively generating an attack waveshape and a slur waveshape suitable for implementing slur effect, and said tone color control means selectively generates said slur waveshape in said attack portion of said tone signal when said first mode is selected and generates said attack waveshape in said attack portion of said tone signal when said second mode is selected.

4. An electronic musical instrument as defined in claim 1 which further comprises a keyboard means having a plurality of keys, said pitch of said tone being designated by a key of said keys, and wherein said mode selection means selects one of said first mode and said second mode in accordance with the manner of operating said key.

5. An electronic musical instrument as defined in claim 1 wherein the tone to be generated has a designated pitch and wherein said second pitch corresponds to said designated pitch of said tone.

6. An electronic musical instrument as defined in claim 1 wherein said first pitch corresponds to a pitch of a tone which has been generated immediately before said tone.

7. An electronic musical instrument as defined in claim 1 wherein said mode selection means selects said first mode when a depressed key has been changed in a legato form which is a manner of operating a key in which a new key is depressed before the precedingly depressed key has been released and otherwise selects said second mode, said first pitch corresponds to a key which has been depressed immediately before said tone and said second pitch corresponds to a newly depressed key.

8. An electronic musical instrument comprising:

tone generating means having at least two tone generation channels for generating a tone having characteristics determined by a first tone signal and a second tone signal generated from said respective generation channels;

pitch change imparting means for gradually changing the pitches of both of said first tone signal and said second tone signal from a first pitch to a second pitch, said gradual changing of pitches being approximately simultaneously performed; and level changing means for, approximately simultaneously with the gradual changing of pitches of the first and second tone signals, gradually changing the amplitude level of said first tone signal from a first level to a second level greater than said first level and for gradually changing the amplitude level of said second tone signal from a third level to a fourth level less than said third level, the rate of changing from said first level to said second level being greater than the rate of changing from said third level to said fourth level.

* * * * *